US005488196A

United States Patent [19]

Zimmerman et al.

[11] Patent Number: 5,488,196

[45] Date of Patent: Jan. 30, 1996

[54] ELECTRONIC MUSICAL RE-PERFORMANCE AND EDITING SYSTEM

[76] Inventors: Thomas G. Zimmerman, 7611 Hollanderry Pl., Cupertino, Calif. 95014; Samuel P. Wantman, 1124 Page St. Apt. #3, San Francisco, Calif. 94117

[21] Appl. No.: 183,489

[22] Filed: Jan. 19, 1994

[51] Int. Cl.[6] ..... G10H 1/02; G10H 1/42; G10H 1/46

[52] U.S. Cl. ..... 84/612; 84/622; 84/629; 84/633; 84/DIG. 12

[58] Field of Search ..... 84/600, 609–614, 84/622–633, 615, DIG. 12

[56] References Cited

U.S. PATENT DOCUMENTS

| | | | |
|---|---|---|---|
| 4,336,734 | 6/1982 | Polson | 84/1.01 |
| 4,704,682 | 11/1987 | Clynes | 84/622 |
| 4,771,671 | 9/1988 | Hoff | 84/1.01 |
| 4,953,439 | 9/1990 | Newell | 84/655 |
| 4,969,384 | 11/1990 | Kawasaki | 84/612 |
| 4,974,486 | 12/1990 | Wallace | 84/609 |
| 4,980,519 | 12/1990 | Mathews | 178/19 |
| 4,981,457 | 1/1991 | Iimura | 446/408 |
| 5,125,313 | 6/1992 | Hiyoshi | 84/600 |
| 5,140,887 | 8/1992 | Chapman | 84/646 |
| 5,288,938 | 2/1994 | Wheaton | 84/600 |
| 5,355,762 | 10/1994 | Tabata | 84/609 |

OTHER PUBLICATIONS

Virtual Guitar User's Manual, 1994, pp. 1–25.

Mathews & Pierce, editors "Current Directions in Computer Music Research", 1989, MIT Press pp. 118, 119, 224, 225, 240, 241, 244, 245 ibid pp. 254–289.

Chabot, "Gesture Interfaces and Software Toolkit for Performance with Electronics", Summer 1990, Computer Music Journal pp. 15–27.

Boulange, "Conducting the Midi Orchestra", Summer 1990, Computer Music Journal pp. 34–46.

Rothstein & Metlay, "Products of Interest", Summer 1990, Computer Music Journal pp. 73–83, 88, 91.

J. Pressing, "Cybernetic Issues in Interactive Performance Systems" Computer Music Journal Spring 1990 pp. 12–25.

Robine & McAvinney "Programmable Finger Tracking Instrument Controller" Computer Music Journal Spring 1990 pp. 26–41.

Knapp & Lusted "A Bielectric Controller for Computer Music Application" Computer Music Journal Spring 1990 pp. 42–47.

Rosenboom "The Performing Brain" Computer Music Journal Spring 1990 pp. 48–50.

Rothstein & Metlay "Products of Interest" pp. 69–72, 79, 82, 83.

Freff "Midi Wind Controller" Keyboard Magazine Mar. 1989 pp. 114–115.

Krefeld "The Hand in the Web" Computer Music Journal Summer 1990 pp. 28–33.

Vercoe & Puckette "Synthetic Rehearsal" ICMC 1985 Proceedings pp. 275–278.

Machover Hyperinstruments: A Progress Report 1987–1991 MIT Media Laboratory.

*Primary Examiner*—Stanley J. Witkowski

[57] ABSTRACT

A music re-performance system allows a plurality of untrained instrumentalist to play pre-stored music using traditional playing techniques along with an automatic accompaniment at a tempo controlled by a selected-instrumentalist. Instrumentalist's gestures start and stop pre-stored score notes and temporal restrictions limit gestural timing errors. Expression parameters, including volume, timbre, and vibrato, are selectively updated, allowing editing of music sound files. A finger manipulation and energy driver controller model, including transducers and signal processing, accommodates wind and string instruments. Temporal masking prevents substantially concurrent finger and energy gestures, intended as simultaneous, from producing multiple false gestures.

34 Claims, 21 Drawing Sheets

Detail Block Diagram of Controller and Scheduler

Fig. 3 Detail Block Diagram of Controller and Scheduler

ELECTRONIC MUSICAL RE-PERFORMANCE AND EDITING SYSTEM

BACKGROUND

1. Field of the Invention

The present invention relates generally to an electronic musical performance system that simplifies the playing of music, and more particularly, to methods and systems for using traditional music gestures to control the playing of music.

2. Description of the Prior Art

TRADITIONAL MUSICAL INSTRUMENTS

Musical instruments have traditionally been difficult to play. To play an instrument a student must simultaneously control pitch, timbre (sound quality), and rhythm. To play in an ensemble, the student must also keep in time with the other musicians. Some instruments, such as the violin, require a considerable investment of time to develop enough mechanical skill and technique to produce a single note of acceptable timbre. Typically a music student will start with simple, often uninspiring, music.

Once a musician becomes proficient at playing a sequence of notes in proper pitch, timbre, and rhythm, the musician can start to develop the skills of expression. Slight variations in the timing of notes, called rubato, and the large scale speeding and slowing called tempo are both temporal methods of bringing life to a musical score. Variations of volume and timbre also contribute to the expression of a musical piece. Musical expression distinguishes a technically accurate, yet dry, rendition of a piece of music from an exciting and moving interpretation. In both instances the correct sequence of notes as specified in a musical score are played, but in the latter, the musician, through manipulation of timing and timbre, has brought out the expressive meaning of the piece which is not fully defined in the score.

For those people who want to experience the pleasures of playing a musical instrument but do not have the necessary training, technique, and skills, they must postpone their enjoyment and endure arduous practice and music lessons. The same applies for those who want to play with others but are not proficient enough to play the correct note at the correct volume, time, and timbre, fast enough to keep up with the others. Many beginning music students abandon their study of music along the way when faced with the frustration and demands of learning to play a musical instrument.

ELECTRONIC MUSIC CONTROLLERS

The introduction of electronic music technology, however, has made a significant impact on students participation in music. A music synthesizer, such as the Proteus from E-mu Systems of Santa Cruz, Calif., allows a novice keyboard player to control a variety of instrument sounds, including flute, trumpet, violin, and saxophone. With the standardization of an electrical interface protocol, Musical Instrument Digital Interface (MIDI), it is now possible to connect a variety of controllers to a synthesizer.

A controller is a device that sends commands to a music synthesizer, instructing the synthesizer to generate sounds. A wide variety of commercially available controllers exist and can be categorized as traditional and alternative. Traditional controllers are typically musical instruments that have been instrumented to convert the pitch of the instrument into MIDI commands. Examples of traditional controllers include the violin, cello, and guitar controllers by Zeta Systems (Oakland, Calif.); Softwind's Synthaphone saxophone controller; the stringless fingerboard synthesizer controller, U.S. Pat. No. 5,140,887, dated Aug. 25, 1992, issued to Emmett Chapman; the digital high speed guitar synthesizer, U.S. Pat. No. 4,336,734, dated Jun. 29, 1982, issued to Robert D. Polson; and the electronic musical instrument with quantized resistance strings, U.S. Pat. No. 4,953,439, dated Sep. 4, 1990, issued to Harold R. Newell.

A technology which is an integral part of many traditional controllers is a pitch tracker, a device which extracts the fundamental pitch of a sound. IVL Technologies of Victoria, Canada manufactures a variety of pitch-to-MIDI interfaces, including The Pitchrider 4000 for wind and brass instruments; Pitchrider 7000 for guitars; and Steelrider, for steel guitars.

Some traditional controllers are fully electronic, do not produce any natural acoustic sound, and must be played with a music synthesizer. They typically are a collection of sensors in an assembly designed to look and play like the instrument they model. Commercial examples of the non-acoustic traditional controllers which emulate wind instruments include Casio's DH-100 Digital Saxophone controller, Yamaha's WXll and Windjamm'r wind instrument controller, and Akai's WE1000 wind controller. These controllers sense the closing of switches to determine the pitch intended by the player.

Alternative controllers are sensors in a system that typically control music in an unconventional way. One of the earliest, pre-MIDI, examples is the Theremin controller where a person controlled the pitch and amplitude of a tone by the proximity of their hands to two antenna. Some examples of alternative controllers include Thunder (trademark), a series of pressure pads controlled by touch, and Lightening (trademark), a system in which you wiggle an infrared light in front of sensors, both developed and Sold by Don Buchla and Associates (Berkeley, Calif.); Videoharp, a controller that optically tracks fingertips, by Dean Rubine and Paul McAvinney of Carnegie-Mellon University; Biomuse, a controller that senses and processes brain waves and muscle activity (electromyogram), by R. Benjamin Knapp of San Jose State University and Hugh S. Lusted of Stanford University; Radio Drum, a three dimensional baton and gesture sensor, U.S. Pat. No. 4,980,519, dated Dec. 25, 1990, issued to Max V. Mathews; and a music tone control apparatus which measures finger bending, U.S. Pat. No. 5,125,313, dated Jun. 30, 1992, issued to Teruo Hiyoshi, et al.

The traditional controllers enable a musician skilled on one instrument to play another. For example, a saxophonist using Softwind's Synthaphone saxophone controller can control a synthesizer set to play the timbre of a flute. Cross-playing becomes difficult when the playing technique of the controller does not convert well to the timbre to be played. For example a saxophonist trying to control a piano timbre will have difficulty playing a chord since a saxophone is inherently monophonic. A more subtle difference is a saxophonist trying to control a violin. How does the saxophonist convey different bowing techniques such as reversal of bow direction (detache and legato), the application of significant bow pressure before bow movement (martele, marcato, and staccato), and dropped, lifted or ricocheted strokes of the bow (pique, spiccato, jete and flying staccato). Conventional violin controllers do not make sufficient measurements of bow contact, pressure, and velocity to respond to these bowing techniques. To do so would encumber the playablity of the instrument or affect its ability to produce a good quality acoustic signal. However, these bow gestures have an important effect on the timbre of sound and are used to convey expression to music.

Tod Machover and his students at M.I.T. have been extending the playing technique of traditional musical instruments by applying sensors to acoustic instruments and connecting them to computers (Machover, T., "Hyperinstrument, A Progress Report 1997–1991", MIT Media Laboratory, January 1992). These extended instruments, called hyperinstruments, allow a trained musicians to experiment with new ways of manipulating synthesized sound. Once such instrument, the Hyperlead Guitars, the timbre of a sequence of notes played by a synthesizer is controlled by the position of the guitarist's hand on the fret board. In another implementation, the notes of guitar chords automatically selected from a score stored inside a computer, are assigned to the strings of a guitar. Picking a string triggers the note assigned to the string, with a timbre determined by fret position. Neither of these implementations allows traditional guitar playing technique where notes are triggered by either hand.

EASY-TO-PLAY MUSICAL ACOUSTIC INSTRUMENTS

Musical instruments have been developed that simplify the production of sound by limiting the pitches that can be produced. The autoharp is a harp with racks of dampers that selectively mute strings of un-desired pitch, typically those not belonging to a particular chord. A harmonica is a series of vibrating reeds of selected pitches. Toy xylophones and piano exists that only have the pitches of a major scale.

VOICE CONTROLLED SYNTHESIZER

Marcian Hoff in U.S. Pat. NO. 4,771,671, dated Sep. 20, 1988, discloses an electronic music instrument that controls the pitch of a music synthesizer with the pitch of a human voice, later manufactured as the Vocalizer by Breakaway Systems (San Mateo, Calif.). The Vocalizer limits pitches to selected ones, similar to an autoharp. The Vocalizer includes a musical accompaniment which dynamically determines which pitches are allowed. If the singer produces a pitch that is not allowed, the device selects and plays the closest allowable pitch.

The difficulty in adopting Hoff's method to play a musical melody is that a vocalized pitch must be produced for each note played. Fast passages of music would require considerable skill of the singer to produce distinct and recognizable pitches. Such passages would also make great demands of the system to distinguish the beginning and ending of note utterances. The system has the same control problems as a saxophone controller mentioned above: singing technique does not convert well to controlling other instruments. For example, how does one strum a guitar or distinguish between bowing and plucking a violin with a voice controller?

ACCOMPANIMENT SYSTEMS

Accompaniment systems exist that allow a musician to sing or play along with a pre-recorded accompaniment. For the vocalist, karaoke is the use of a predefined, usually prerecorded, musical background to supply contextual music around which a person sings a lead part. Karaoke provides an enjoyable way to learn singing technique and is a form of entertainment. For the instrumentalist, a similar concept of "music-minus-one" exists, where, typically, the lead part of a musical orchestration is absent. Hundreds of classical and popular music titles exist for both karaoke and music-minus-one. Both concepts require the user to produce the correct sequence of notes, with either their voice or their instrument, to play the melody.

Musical accompaniment also exists on electronic keyboards and organs, from manufacturers such as Wurlitzer, Baldwin, Casio, and Yamaha, which allow a beginner to play a simple melody with an automatic accompaniment, complete with bass, drums, and chord changes.

A more sophisticated accompaniment method has been designed independently by Barry Vercoe (Vercoe, B., Puckette, M., "Synthetic Rehearsal: Training the Synthetic Performer", ICMC 1985 Proceedings, pages 275–278; Boulanger, R., "Conducting the MIDI Orchestra, Part 1", Computer Music Journal, Vol. 14, No. 2, Summer 1990, pages 39–42) and Roger Dannenberg (ibid., pages 42–46). Unlike previous accompaniment schemes where the musician follows the tempo of the accompaniment, they use the computer accompaniment to follow the tempo of the live musician by monitoring the notes played by the musician and comparing it to a score stored in memory. In Vercoe's system a flute and a violin were used as the melody instruments. In Dannenberg's system a trumpet was used.

In all of the cases of accompaniment mentioned, the person who plays the melody must still be a musician, having enough skill and technique to produce the proper sequence of pitches at the correct times and, where the instrument allows, with acceptable timbre, volume, and other expressive qualities.

SYSTEMS WITH STORED MELODY

In order to reduce the simultaneous tasks a person playing music must perform, a music re-performance system can store a sequence of pitches, and through the action of the player, output these pitches. A toy musical instrument is described in U.S. Pat. No. 4,981,457, by Taichi Iimura et al, where the closing of a switch by a moveable part of the toy musical instrument is used to play the next note of a song stored in memory. Shaped like a violin or a slide trombone, the musical toy is an attempt to give the feeling of playing the instrument the toy imitates. The switch is closed by moving a bow across the bridge, for the violin, or sliding a slide tube, for the trombone. The length of each note is determined by the length of time the switch is closed, and the interval between notes is determined by the interval between switch closing. No other information is communicated from the controller to the music synthesizer.

The toy's limited controller sensor, a single switch makes playing fast notes difficult, limiting expression to note timing, and does not accommodate any violin playing technique that depends on bow placement, pressure, or velocity, and finger placement and pressure. Similarly the toy does not accommodate any trombone playing techniques that depends on slide placement, lip tension, or air pressure. The limited capability of the toy presents a fixed level of complexity to the player which, once surpassed, renders the toy boring.

The melody for a song stored in the toy's memory has no timing information, making it impossible for the toy to play the song itself, to provide guidance for the student, and does not contain any means to provide any synchronized accompaniment. The toy plays monophonic music while a violin, having four strings, polyphonic. The toy has no way to deal with a melody that starts a note before finishing the last, or ornamentations a player might add to a re-performance, such as playing a single long note as a series of shorter notes.

Another system that simplifies the tasks of the person playing music is presented by Max Mathews in his Conductor Program (Mathews, M. and Pierce, J., editors, "The Conductor Program and Mechanical Baton", Current Directions in Computer Music Research, The MIT Press, 1989, Chapter 19; Boulanger, R., "Conducting the MIDI Orchestra, Part 1", Computer Music Journal, Vol. 14, No. 2, Summer 1990, page 34–39). In Mathews' system a person conducts a score, which is stored in computer memory, using special batons, referred to earlier as the alternative controller Radio Drum.

Mathews' system is basically a musical sequencer with synchronization markers distributed through the score. The sequencer plays the notes of the score at the times specified, while monitoring the actions of the batons. If the sequencer reaches a synchronization marker before a baton gesture, the sequencer stops the music and waits for a gesture. If the baton gesture comes in advance of the marker, the sequencer jumps ahead to the next synchronization marker, dropping the notes in between. The system does not tolerate any lapses of attention by the performer. An extra beat can eliminate a multitude of notes. A missed beat will stop the re-performance.

Expressive controls of timbre, volume, pitch bend are controlled by a combination of spatial positions of the batons, joystick and knobs. Designed primarily as a control device for the tempo and synchronization of an accompaniment score, there are no provisions for controlling the relative timing of musical voices in the score. The controller is a cross between a conductor's baton and a drum mallet and does not use the gestures and playing techniques of the instruments being played. There is no way for several people to take part in the re-performance of music. Mathews' conductor system is a solo effort with no means to include any other players.

None of the systems and techniques presented that are accessible to non-musicians provides an adequate visceral and expressive playing experience of the instrument sounds they control. The natural gestural language people learn and expect from watching instruments being played are not sufficiently utilized, accommodated, or exploited in any of these system.

MIDI SEQUENCERS

With the advent of standardization of the electronic music interface, MIDI, many software application programs called sequencers became available to record, store, manipulate, and playback music. Commercial examples include Cakewalk by Twelve Tone Systems and Vision by Opcode Systems. One manipulation technique common to most sequencers is the ability to change the time and duration of notes. One such method is described in U.S. Pat. No. 4,969,384, by Shingo Kawasaki, et al., where the duration of individual sections of music can be shortened or lengthened.

Music can be input into sequencers by typing in notes and durations, drawing them in using a mouse pointing device, or more commonly, using the sequencer as a tape recorder and "playing live". For those not proficient at playing keyboard it is often difficult to play the correct sequence of notes at the correct time, with the correct volume. It is possible to "play in" the correct notes without regard for time and edit the time information later. This can be quite tedious as note timing is edited "off line", that is non-real time, yet music is only perceived while it is being played. Typically this involves repeatedly playing and editing the music in small sections, making adjustments to the location and duration of notes. Usually the end result is stilted for it is difficult to "edit-in" the feel of a piece of music.

It is therefore desirable to have a music editing system where selected music parameters (e.g. volume, note timing, timbre) can be altered by a musician re-playing the piece. Such a system, called a music re-performance system, would allow a musician to focus on the selected parameters being edited.

SUMMARY DESCRIPTION OF THE INVENTION

An object of the invention is to provide a musical re-performance system to allow a person with a minimum level of skill to have a first-hand experience of playing a musical instrument using familiar playing techniques. The music re-performance system is easy enough to operate that a beginner with little musical skill can play a wide variety of musical material, with recognizable and good sounding results. The system can tolerate errors and attention lapses by the player. As the student gains more experience, the system can be adjusted to give the student greater control over note timing and expression.

To accomplish these goals the music re-performance system provides an instrument controller that is played using traditional playing techniques (gestures), a scheduler that plays preprogrammed notes in response to gestures from the controller, and an accompaniment sequencer that synchronizes to the tempo of the player. The scheduler maintains a tolerance for gesture timing error to handle missed and extra gestures. Expressive parameters including volume, timbre, and vibrato and can be selectively controlled by the score, the player's gestures, or a combination of the two. The system takes care of the note pitch sequence and sound generation, allowing the player to concentrate on the expressive aspects of music.

The similarity between the playing technique of the controller and the traditional instrument allows experiences learned on one to carry over to the other, providing a fun entry into music playing and study. A beginner can select a familiar piece of music and receive the instant gratification of playing and hearing good sounding music. As the player gains skill, more difficult music can be chosen and greater control can be commanded by the player, allows the system to track the development of the player. Music instruction, guidance and feedback are given visually, acoustically, and kinesthetically, providing a rich learning environment.

Another object of the invention is to allow a plurality of people with a minimum level of skill to have the first-hand experience of playing in an ensemble, from a string quartet to a rock-and-roll band. The music re-performance system can take over any of the players parts to assist with difficult passages or fill in for an absent musician. A video terminal displays multi-part scores, showing the current location of each player in the score. The system can accommodate any number of instrument controller, monophonic or polyphonic, conventional MIDI controllers or custom, and accept scores in standard MIDI file format.

To accomplish these goals a scheduler is assigned to each controller. If a controller is polyphonic, like a guitar, a scheduler containing multiple scheduler, one for each voice (e.g. six for a guitar) is assigned. To play a part automatically, the scheduler for that part is set with zero tolerance for gesture error. The scheduler can automatically analyze a score and determine when a sequence of notes should be played with one gesture, making fast passages easier to play. The system can accommodate accompaniment that is live, recorded audio, or stored in memory.

Another object of the invention is to provide controllers that play like traditional instruments, provide greater control and are less expensive to manufacture then MIDI controllers, and are interchangeable in the system. To accomplish these goals traditional instruments are modeled as having two components; an energy source that drives the sound and finger manipulation that changes the pitch of the instrument. Transducers appropriate to each instrument are used to convert these components into electric signals which are processed into standardized gesture outputs. The common model and standardized gestures allow the system to accommodate a variety of instruments. Wind controllers have been developed, particularly the Casio DH-100 Digital Saxophone, that can easily be adapted to the music re-performance system.

Commercially available string controllers, including guitars and violin, suffer from one or more of the following problems:

They are to difficult for non-musicians to play.

They do not allow enough expressive control of the music.

They hinder the development of skill and technique.

They do not use traditional playing techniques.

They are expensive.

Another object of the invention is to address these problems by making expressive, responsive, and inexpensive string controllers that use traditional playing techniques, with a music performance system that is easy to use and can be adjusted to match the skill level of the player.

Another object of the invention is to be able to edit selected parameters of a score (e.g. timing, volume, brightness) by playing those parameters live, without having to worry about the accuracy of the unselected parameters. Such editing can give life and human feel to a musical piece that was, for example, transcribed from a written score. To accomplish this only the parameters selected to be edited (e.g. note volume) are updated when playing the controller, leaving all other parameters unchanged.

These and other advantages and features of the invention will become readily apparent to those :skilled in the art after reading the following detailed description of the invention and studying the accompanying drawings.

DESCRIPTION OF THE INVENTION AND PREFERRED EMBODIMENT

OVERVIEW

Figure 1:
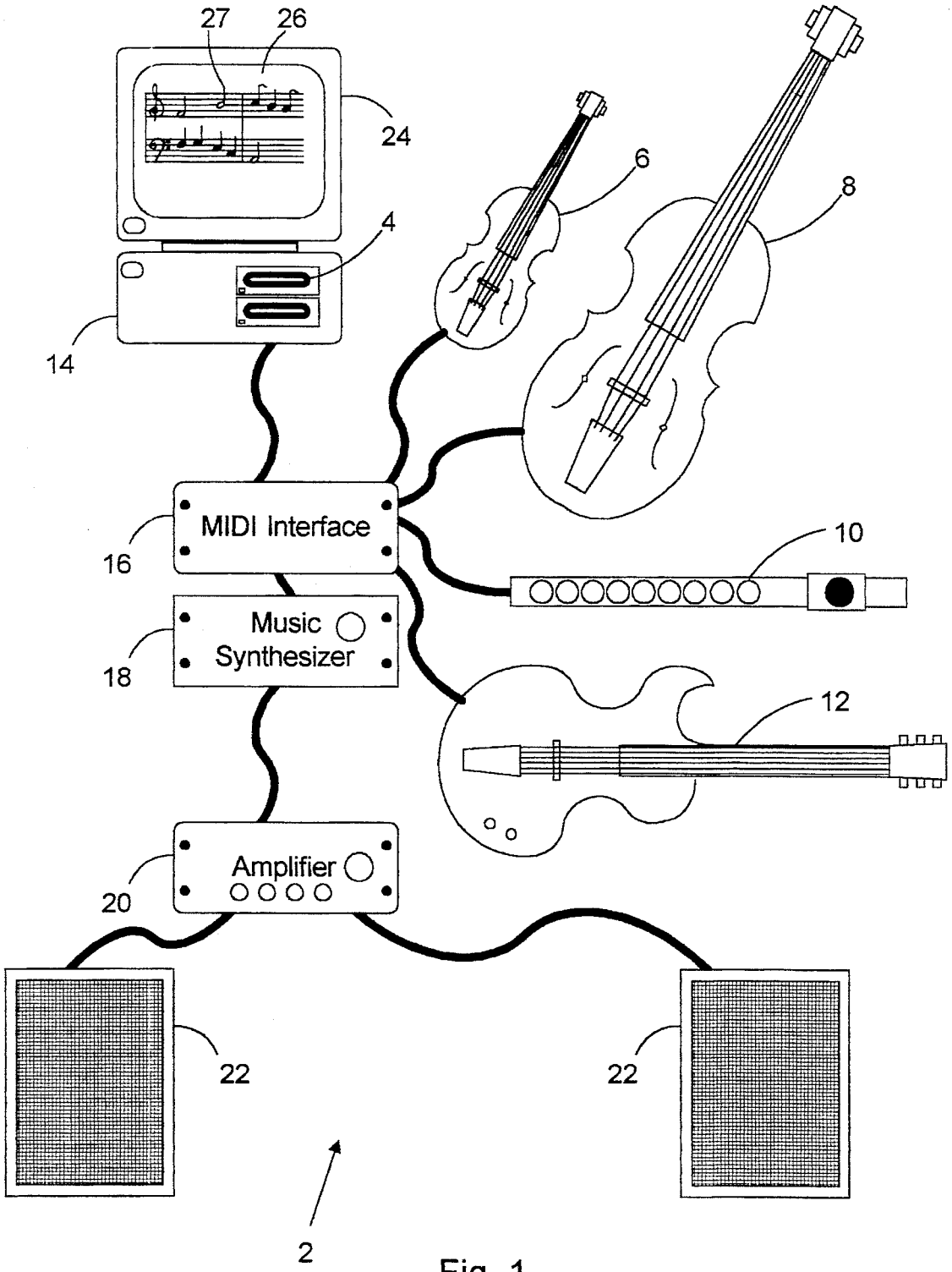
FIG. 1 is a schematic block diagram of an embodiment of the music re-performance system for four instruments with accompaniment.

FIG. 1 Shows an embodiment of the music re-performance system 2 to allow four people to play a musical piece stored in a score memory 4. Each person plays a musical controller 6,8,10,12 which is shaped like a traditional musical instrument. The quartet of musical controllers 6,8,10,12 assembled in FIG. 1 are a violin controller 6, cello controller 8, flute controller 10, and guitar controller 12. These controllers can be conventional MIDI instrument controllers, which are available for most traditional instruments, or ones embodied in the invention that will be discussed later.

In order to describe the operation of the music re-performance system 2, the concept of gestures and expression commands are introduced. When a person plays a musical instrument their actions (e.g. strumming, bowing, and fretting a string) are converted by the instrument into, acoustic sound. Some actions start, stop, and change the pitch of the sound (e.g. fretting and picking strings), others change the loudness and timbre of the sound (e.g. changing bowing pressure). For the purposes of the music re-performance system 2, the former actions are called player gestures, the latter actions are called expression commands.

There are three types of player gestures: START, STOP, and STOP-START. The player gestures describe the action they produce. A START starts one or more notes, a STOP stops all the notes that are on (i.e. sounding), and a STOP-START stops one or more notes and starts one or more notes. From silence (all notes off), the only possible player gesture is START. When at least one note is on, a STOP-START or STOP player gesture is possible. After a STOP player gesture, only a START is possible.

When conventional MIDI controllers are used in the music reperformance system 2, a START corresponds to the MIDI commands NOTE ON, a STOP corresponds to NOTE OFF, and a STOP-START corresponds to a NOTE OFF immediately followed by a NOTE ON. Expression commands include the MIDI commands PROGRAM CHANGE, PITCH BEND, and CONTROLLER COMMANDS.

Each controller, 6,8,10,12; transmits gesture and expression commands of a player (not shown) to the computer 14 though a MIDI interface unit 16. The computer 14 receives the gesture and expression commands, fetches the appropriate notes from the musical score 4, and sends the notes with the expression commands to a musical synthesizer 18, whose audio output is amplified 20 and played out loudspeakers 22.

The MIDI interface unit 16 provides a means for the computer 14 to communicate with MIDI devices. MIDI is preferred as a communication protocol since it is the most common musical interface standard. Other communication methods include the RS-232 serial protocol, by wire, fiber, or phone lines (using a modem), SCSI, IEEE-488, and Centronics parallel interface.

The music score 4 contains note events which specify the pitch and timing information for every note of the entire piece of music, for each player, and may also include an accompaniment. In a preferred embodiment, score data 4 is stored in the Standard MIDI File Format 1 as described in the MIDI File Specification 1.0. In addition to pitch and timing information, the score may include expressive information such as loudness, brightness, vibrato, and system commands and parameters that will be described later. In a preferred embodiment system commands are stored in the MIDI file format as CONTROLLER COMMANDS.

Examples of the computer 14 in FIG. 1 include any personal computer, for example an IBM compatible personal computer, or an Apple Macintosh computer.

The media used store the musical score data 4 can be read-only-memory ROM circuits, or related circuits, such as EPROMs, EEROMs, and PROMs; optical storage media, such as videodisks, compact discs CD ROM's, CD-I discs, or film; bar-code on paper or other hard media; or magnetic media such as floppy disks of any size, hard disks, magnetic tape; audio tape cassette or otherwise; or any other media which can store score data or music, or any combination of media above. The medium or media can be local, for example resident in the embodiment of the music reperformance system 2, or remote, for example separately housed from the embodiment of the music re-performance system 2.

A video display 24 connected to the computer 14 displays a preferred visual representation 26 of the score in traditional music notation. As each player gestures a note 27, the gestured note 27 changes color, indicating the location of the player in the score. An alternative representation of the score is a horizontal piano scroll (not shown) where the vertical position of line represent pitch, and the length of the lines represents sustain time.

Many music synthesizers 18 exist that would be suitable including the PROTEUS from E-UM Systems, Sound Canvas from Roland, and TX-81Z from Yamaha.

The media which is used to store the accompaniment include any of the score storage media discusses above or can be live or prerecorded audio, on optical storage media such as videodisks, compact discs CD ROM's, CD-I discs, or film; magnetic media such as floppy disks of any size, hard disks, magnetic tape; audio tape cassette or otherwise; phonograph records; or any other media which can store digital or analog audio, or any combination of media above. The medium or media can be local or remote.

Figure 2:
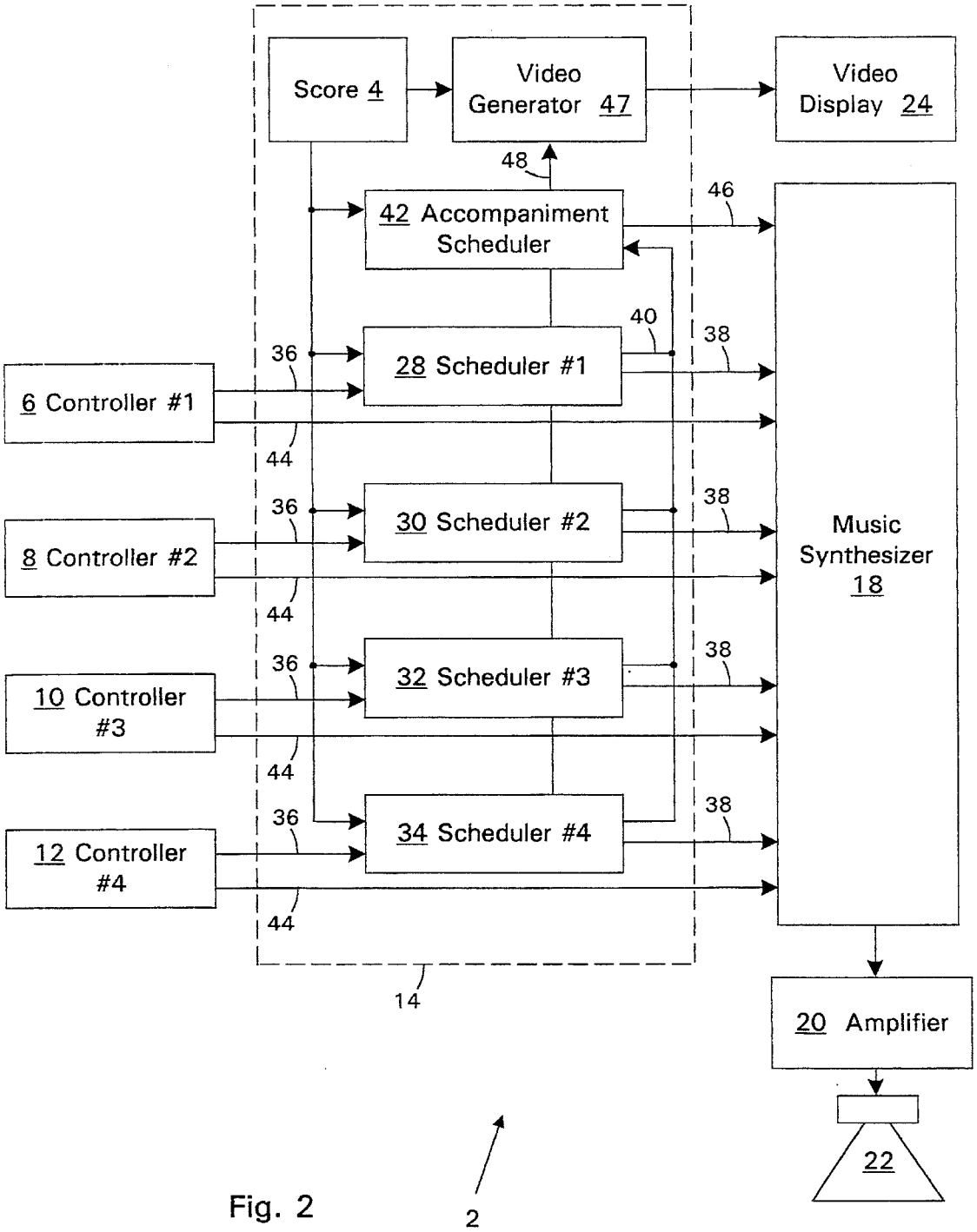
FIG. 2 is a block diagram of the system component of the embodiment of FIG. 1.

FIG. 2 shows a block diagram of the music re-performance system 2. The following discussion of the operation of the controller 6 and scheduler 28 applies to controllers 8,10,12 and schedulers 30,32,34 as well. The scheduler 28 collects note events from the score 4 that occur close together in time, groups them as pending events, and determines what type of player gesture is required by the group. For example, the first NOTE ON event of a piece is a pending event requiring a START player gesture, two events that happen close together that stop a note and start another form a pending events group requiring a STOP-START player gesture, and an event that stops all the notes currently on requires a STOP player gesture.

The controller 6 sends player gestures 36 to the scheduler 28. The scheduler 28 matches player gestures 36 to the gestures required by the pending events, and sends the matched events as note output commands 38 to the music synthesizer 18. When all the pending events are successively matched up and sent out, the scheduler 28 selects the next collection of pending events. The scheduler 28 calculates tempo changes by comparing the time of the player gestures 36 with the times of the note events as specified in the score 4. These tempo change calculations are sent as tempo change commands 40 to the accompaniment sequencer 42.

The controller 6 also sends expression commands 44 directly to the music synthesizer 18. These expression commands 44 include volume, brightness, and vibrato commands which change corresponding parameters of the synthesizer 18. For example if the controller 6 is a violin, bowing harder or faster might send a volume expression command 44 telling the music synthesizer 18 play the notes louder.

The accompaniment sequencer 42 is based on a sequencer, a common software program, which reads the score 4 and sends note and expression commands 46 the music synthesizer 18, at the times specified by the score 4, and modified to work at a tempo specified by one of the schedulers 28, 30, 32, 34.

Examples where the accompaniment sequencer 42 may not be required include an ensemble where all the parts are played by controllers 6, when the accompaniment is provided by an audio source, or when the accompaniment is live musicians. In one embodiment of the music re-performance system 2, a solo player using one controller 6 plays the lead part of a piece of music, accompanied by a "music-minus-one" audio recording.

The video generator 47 displays the current page of the music score 4 on the video display 24, and indicates the location of the accompaniment sequencer 42 and all the controllers 6, 8, 10, 12 in the musical score 4, by monitoring the note output commands 38 of the controllers 6, 8, 10, 12 and accompaniment sequencer 42, sent on the note data bus 48. Methods to display the score 4 and update the locations of the controllers 6, 8, 10, 12 and accompaniment sequencer 42 in the score 4, are well known to designers of commercial sequencer programs like Cakewalk from Twelve Tone Systems and will not be reviewed here.

Figure 3:
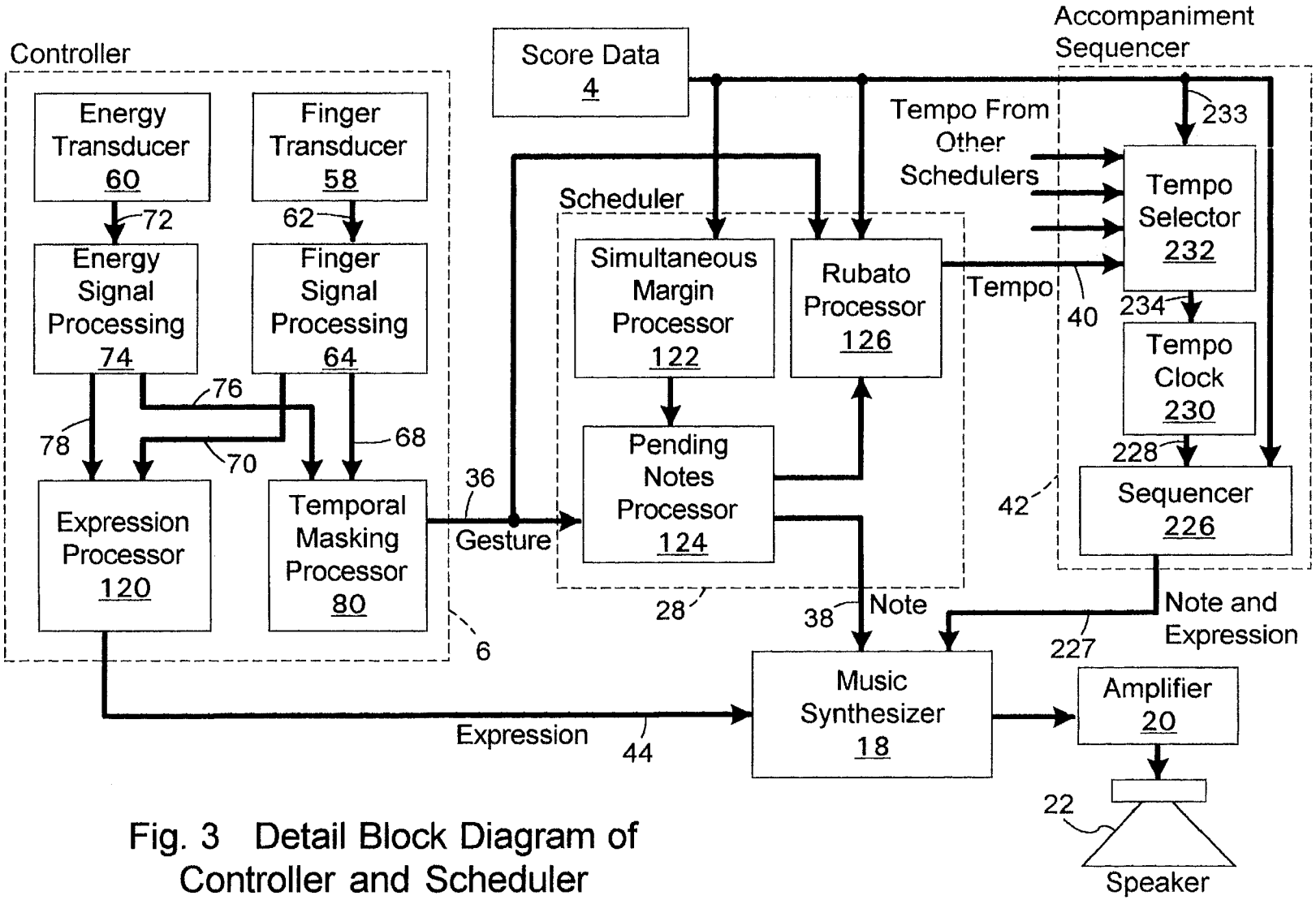
FIG. 3 is a detail block diagram of a portion of the embodiment of FIG. 1, showing the components of the controller, scheduler, and accompaniment sequencer.

FIG. 3 shows a detailed block diagram of the three main components of the music re-performance system: the controller 6, scheduler 28, and accompaniment sequencer 42. Each of these components will be examined. If the controller 6 is a conventional MIDI instrument controller, the functional blocks inside the controller 6 are performed by the MIDI controller. A MIDI instrument controller serving as the controller 6 will be considered first.

CONTROLLER 6

The MIDI output from the controller 6 is separated into two streams; player gestures 36 and expression commands 44. The expression commands 44 are passed from the controller 6 directly the music synthesizer 18 and control the expression (e.g. volume, brightness, vibrato) of the instrument sound assigned to the controller 6.

An alternative to using a MIDI controller is provided by the invention. Since the pitch is determined by the score 4 and not the controller 6, the invention offered the opportunity to design controllers that are less expensive and easier play than conventional MIDI controllers. One skilled in the art of instrument design and instrumentation need only construct a controller 6 that provides player gestures 36 and expression commands 44 to the invention to play music. The blocks inside the controller 6 illustrate a preferred means of designing a controller 6 for the invention.

The controller 6 for any music instrument is modeled as a finger transducer 58 and an energy transducer 60. Table 1 classifies common musical instruments into four categories. Table 2 lists the measurable phenomena for the energy transducer 60 of each instrument class. Table 3 lists the measurable phenomena for the finger transducers 58 of each instrument class.

TABLE 1

INSTRUMENT CLASSIFICATION

| Class | Examples |
|---|---|
| bowed strings | violin, viola, cello, bass |
| picked strings | guitar, bass, banjo, ukulele |
| blown | recorder, clarinet, oboe, flute, piccolo, trumpet, French horn, tuba |
| blown slide valve | trombone |

TABLE 2

ENERGY MEASUREMENT PARAMETERS

| Class | Phenomena |
|---|---|
| bowed string | bow position, velocity, pressure |
| picked string | string vibration amplitude |
| blown | air pressure, velocity |
| blown slide valve | air pressure, velocity |

TABLE 3

FINGER MEASUREMENT PARAMETERS

| Class | Phenomena |
|---|---|
| bowed string | string contact position and pressure |
| picked string | string contact position and pressure |
| blown | switch closure and pressure |
| blown slide valve | valve position |

The music instrument model is general enough to include all the instruments listed in Table 1. Many sensors exist to measure the phenomena listed in Table 2 and Table 3. To design a controller 6 for a particular instrument sensors are selected to measure the energy and finger phenomena particular to the instrument, preferably utilizing traditional playing techniques. Signal processing is chosen to generate gestures and expression from these phenomena. Gestures are :intentional actions done by the player on their instrument to start and end notes. Expression are intentional actions done by the player on their instrument to change the volume and timbre of the sound they are controlling.

FINGER TRANSDUCER 58

Referring to FIG. 3, the finger transducer 58 senses finger manipulation of the controller 6 and produces a finger manipulation signal 62 responsive to finger manipulation. The finger signal processing 64 converts the finger manipulation signal 62 into a binary finger state 68, indicating the application and removal of a finger (or sliding of a valve for a trombone) and a continuous finger pressure 70, indicating the pressure of one or more fingers on the finger transducer 58.

ENERGY TRANSDUCER 60

The energy transducer 60 senses the application of energy to the controller 6 and converts the applied energy to an energy signal 72. The energy signal processing 74 converts the energy signal 72 into a binary energy state 76, indicating energy is being applied to the controller 6, and into a continuous energy magnitude 78, indicating the amount of energy applied to the controller 6.

TEMPORAL MASKING PROCESSOR 80

In a musical instrument, notes can be started, stopped, and changed by the energy source (e.g. bowing a string or blowing a flute), and changed by finger manipulation (e.g. fretting a string or pushing or releasing a valve on a flute). In the controller model 6, these actions correspond to energy gestures 82 (not shown) and finger gestures 96 (not shown), respectively. In a traditional instrument when these gestures are done close together in time (substantially simultaneous), the acoustic and mechanical properties of the instrument produces a graceful result. In an electronic system capable of high speed responses, an energy gesture 82 and finger gesture 96 intended by the player to be simultaneous, will more likely be interpreted as two distinct gestures, producing unexpected results. The temporal masking processor 80 is designed to combine the two gestures into the single response expected by the player.

In the embodiment of the music re-performance system 2 shown in FIG. 1, the implementation of the scheduler 28, accompaniment sequencer 42, and the task of separating the player gestures 36 from the expression commands 44 from the MIDI controller 6, is performed in software in the computer 14. The MIDI interface unit 16 is not shown explicitly in FIG. 3 but provides for the communication of player gestures 36, expression commands 44, and note output commands 38 to the computer 14 and music synthesizer 18.

Figure 4:
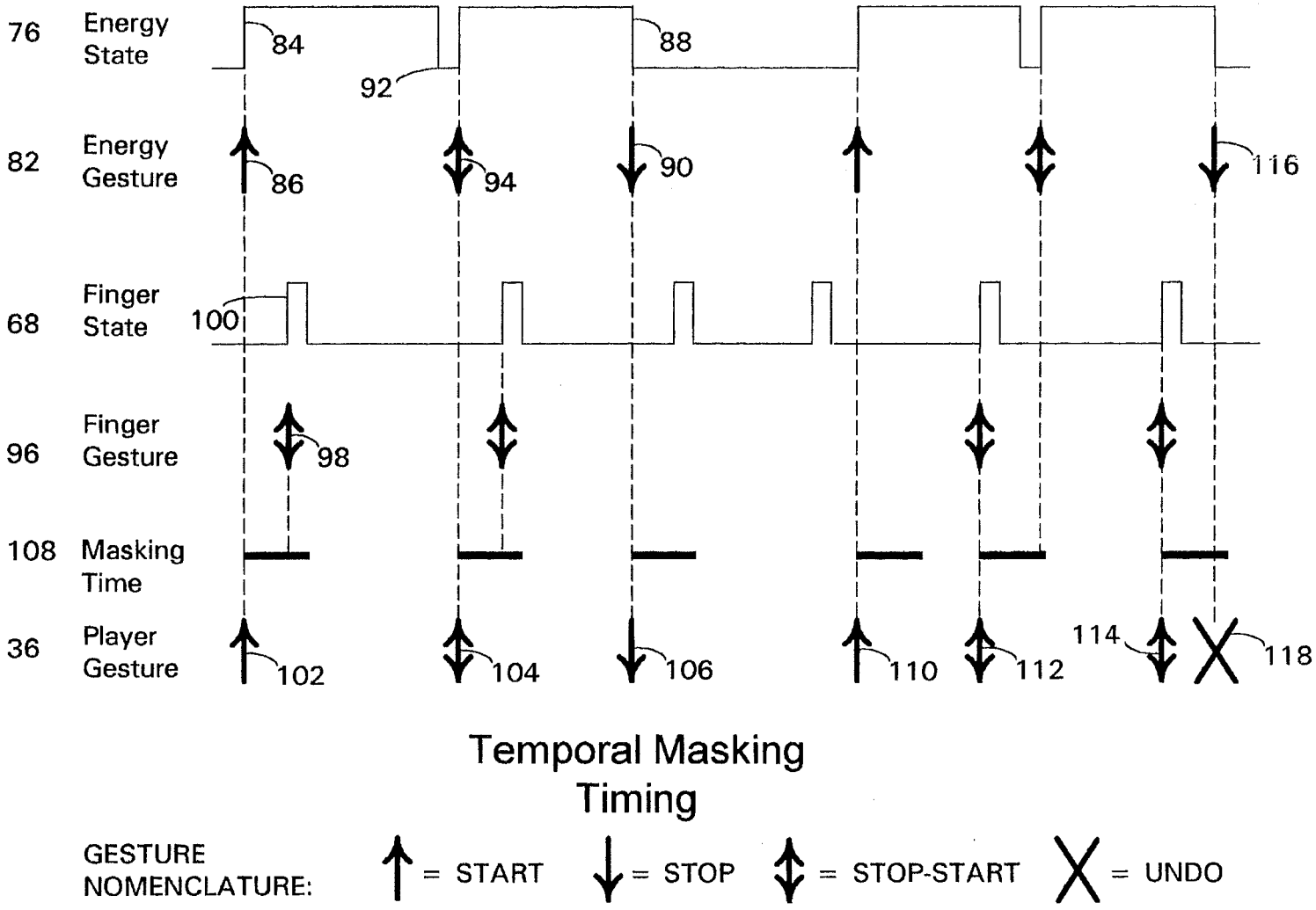
FIG. 4 illustrates by means of icons and timing information the operation of the temporal masking processor shown in the controller of FIG. 3.

FIG. 4 shows a pictorial timing diagram of gestures applied to and output from the temporal masking processor 80. The energy state 76 is a binary level applied to the temporal masking processor 80 that is high only when energy is being applied to the controller 6 (e.g. blowing or bowing). The temporal masking processor 80 internally generates an energy gesture 82 in response to changes in the energy state 76. A rising edge 84 of the energy state 76 produces a START energy gesture 86 (represented by an arrow pointing up), a falling edge 88 produces a STOP energy gesture 90 (arrow pointing down), and a falling edge followed by a rising edge. 92, within a margin of time, produces a STOP-START energy gesture 94 (two headed arrow). The margin of time can be fixed, variable, a fraction of a note duration, or based on the tempo of the song. In a preferred embodiment, the margin of time is fixed (e.g. 50 milliseconds).

The finger state 68 is a binary level applied to the temporal masking processor 80 that is pulsed high when a finger is lifted or applied, or in the case of a trombone, the slide valve is moved in or out an appreciable amount. The temporal masking processor 80 internally generates a finger gesture 96 on the rising edge 100 of the finger state 68, if and only if the energy state 76 is high. There is only one type of finger gesture 96, the STOP-START 98, represented by a two-headed arrow.

There are six possible energy gesture 82 and finger gesture 96 sequence combinations, as shown in FIG. 4. When the energy state 76 changes, the player gesture 36 of the temporal masking processor 80 is the corresponding energy gesture 82, as in the case of 102, 104, and 106. If finger gestures 96 occur within the masking time 108 they are ignored. The masking time 108 can be fixed, variable, a fraction of a note duration, or based on the tempo of the song. In a preferred embodiment the masking time 108 is a fraction of the duration, of the next note to be played by the scheduler 28. In this way, short quick notes produce small masking times 108, allowing many energy gesture 82 and finger gestures 96 to pass through as player gestures 36, while slow long notes are not accidentally stopped or started by multiple gestures intended as one.

When the temporal masking processor 80 detects a rising edge 100 of the finger state. 68, the corresponding player gesture 36 is player gesture 36, as in case 112, and 114. If an energy gesture 82 occurs within the masking time 108 it is ignored unless it is a STOP energy gesture 82, as in case 116, in which case the temporal masking processor 80 outputs an UNDO command 118 (represented as X). Upon receiving the UNDO 118 command, the scheduler 28 stops all the notes currently on (as is always done by a STOP gesture), and "takes-back" the erroneous STOP-START gesture 114. Typically in a software implementation of a scheduler 28, this means moving internal pointers of the scheduler 28 back to the notes started by the erroneous STOPSTART gesture 114, preparing to start them again on the next START gesture.

EXPRESSION PROCESSOR 120

Referring back to the block diagram of the controller 6 shown in FIG. 3, the expression processor 120 receives the continuous energy magnitude 78 and the continuous finger pressure 70, and produces expression commands 44 which are sent to the music synthesizer 18 to effect the volume and timbre of the sound assigned to the controller 6. In a preferred embodiment, the expression processor 120 outputs vibrato depth expression commands 44 in proportion to finger pressure fluctuations 70, and outputs volume expression commands 44 in proportion to energy magnitude 78.

SCHEDULER 28

The scheduler 28 receives the finger gestures 96 from the controller 6, consults the score 4, sends tempo change commands 40 to the accompaniment sequencer 42, and note output commands 38 to the music synthesizer 18. These tasks are performed by three processors: the simultaneous margin processor 122, the pending notes processor 124, and the rubato processor 126.

The simultaneous margin processor 122 fetches note events from the score 4 and sends them to the pending notes processor 124, where they are stored as pending note events. The pending notes processor 124 receives player gestures 36 from the controller 6, checks them against the pending note events, and sends note output commands 38 to the music synthesizer 18. The rubato processor 126 calculates tempo changes by comparing the timing of player gestures 36 to pending note events, and sends tempo change commands 40 to the accompaniment sequencer 42.

Figure 5A:
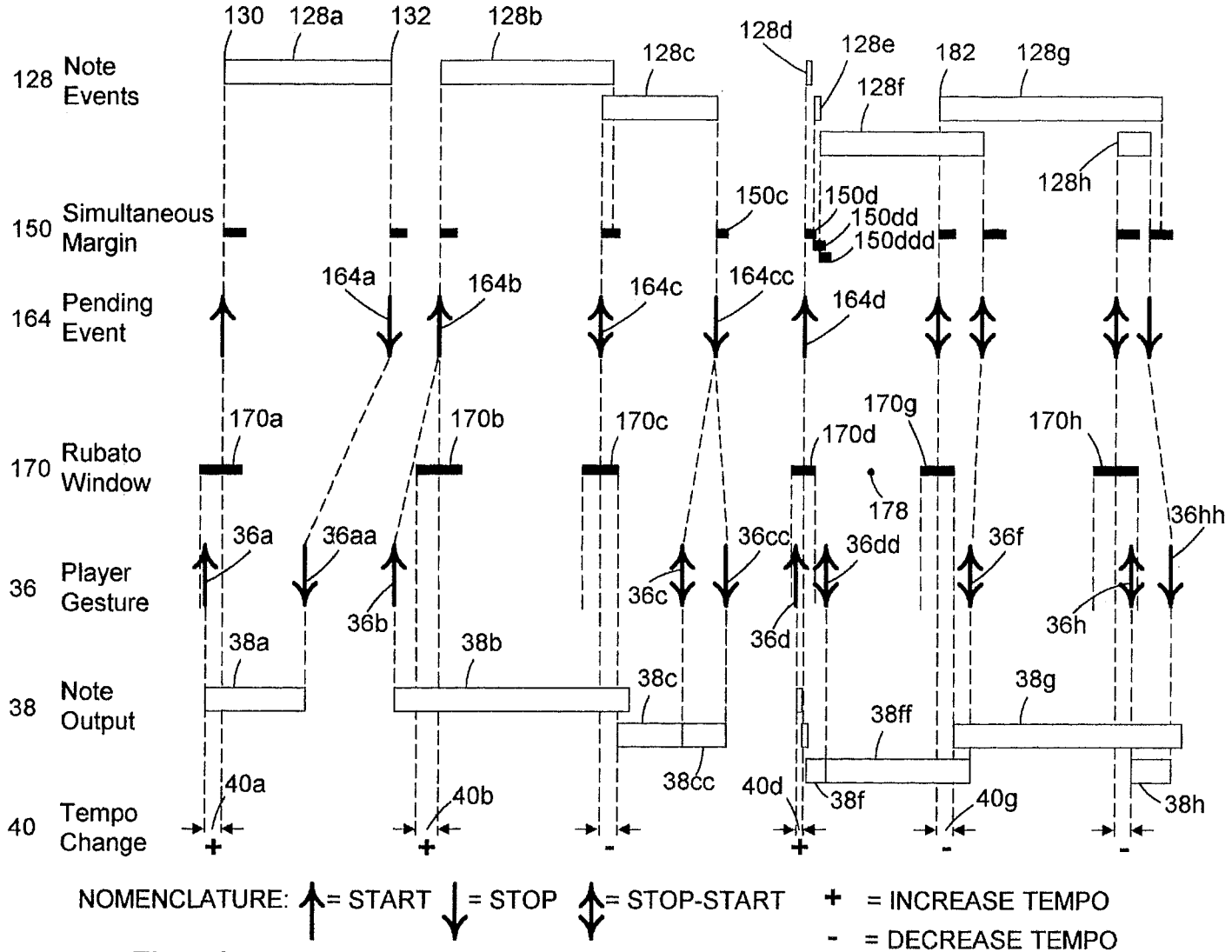
FIG. 5A pictorially illustrates the operation of the scheduler shown in FIG. 3.

FIG. 5A is a pictorial timing diagram showing the operation of the scheduler 28.

SIMULTANEOUS MARGIN PROCESSOR 122

Scored notes 128 are stored in the score 4 in chronological order. Each scored note 128 is stored as two commands: a NOTE ON 130 which indicates the pitch, starting time, and volume of a note, and NOTE OFF 132 which indicates the pitch and stopping time of a note. To describe the operation of the simultaneous margin processor 122, a section of a score containing eight notes 134i a–134*h*, designated for one controller 6, is considered in FIG. 5A. The simultaneous margin processor 122 fetches all the next note events in the score 4 that occur within a time margin, called the simultaneous margin 150, and send them to the pending notes processor 124, where they are referred to as pending events. In a preferred embodiment, the simultaneous margin 150 is calculated as a percentage (e.g. 10%) of the duration of the longest note in the last pending events group, and is reapplied to each note event that occurs within the simultaneous margin 150.

The simultaneous margin 150*c* for the stop of scored note 128*c* is calculated as 10% of the duration of scored note 128*b* (the longest, and only, note duration of the last pending events). The stop of scored note 128*c* is the only event occurring inside the simultaneous margin 150*c*, so one STOP pending event 164*cc*, is contained in the pending notes processor 124.

Figure 5B:
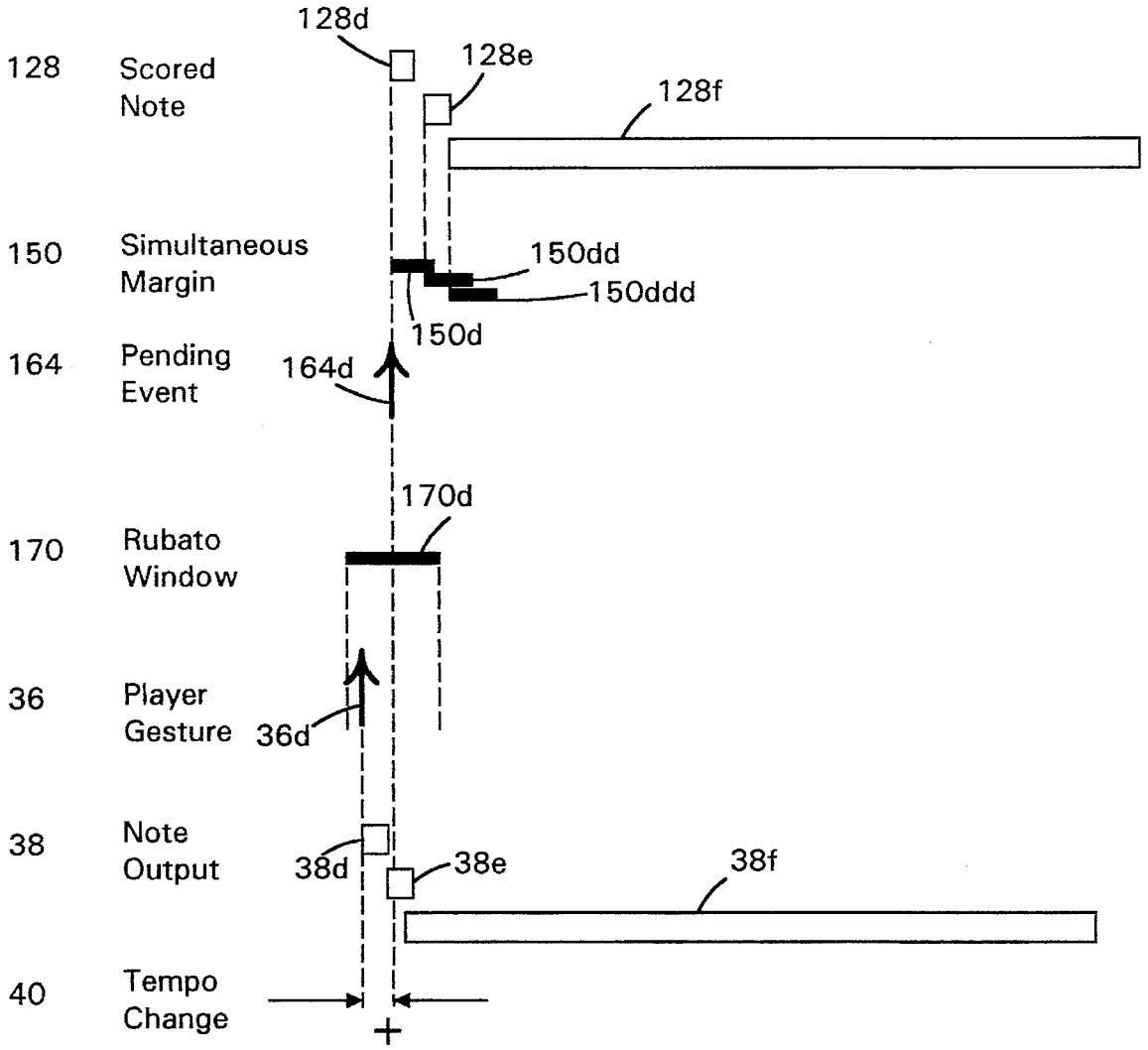
FIG. 5B shows a detail of FIG. 5A to illustrate the operation of the simultaneous margin processor.

FIG. 5B is a detailed view of a section of FIG. 5A, examining how the simultaneous margin processor 122 deals with the concatenation of simultaneous margins. The simultaneous margin 150*d* for the start of scored note 128*d* is 10% of the duration of scored note 128*c*. The stop of scored note 128*d* falls within the simultaneous margin 150*d*, so the event STOP note 128*d* is also sent to the pending notes processor 124. The start of scored note 128*e* falls within the simultaneous margin 150*d*, so the start of scored note 128*e* is sent to the pending notes processor 124, and the simultaneous margin 150*dd* (still 10% of the duration of note 128*c*) is applied at the start of scored note 128*e*. By the same process, the stop of scored note 128*e* and the start of scored note 128*f* are sent to the pending notes processor 124. The pending events for the collection of note events falling within the concatenated simultaneous margins 150*d*, 150*dd*, and 150*ddd* are; START note 128*d*, STOP note 128*d*, START note 128*e*, STOP note 128*e*, and START note 128*f*.

Concatenating simultaneous margins 150 can lead to an undesirable situation when a string of quick :notes (e.g. sixteenth notes) are grouped together as one pending events group. To prevent this from occurring, a limitation on concatenation may be imposed. Limitations include a fixed maximum simultaneous margin length, a relative length based on a fraction of the duration of the longest note in a simultaneous margin, or a variable length set in the score 4 or by the player. In a preferred embodiment, the maximum concatenated simultaneous margin length is a fraction of the duration of the longest note in a simultaneous margin, with the fraction determined by con, hands in the score 4. This embodiment allows the fraction to be optimized for different sections and passages of the score 4, for example slow passages would have large fractions, and fast section with a series of quick notes would have a smaller fraction.

In alternate embodiments, the simultaneous margin 150 may be a fixed time, for example set by the player; variable time, for example percentages of other parameters including tempo or other note durations; arbitrary times edited into the score 4 by the creator of the score; or iteratively updated, based on the errors of a player each time the score 4 is performed. In the last case, if the player misses gesturing a particular pending event, the system successively increases the simultaneous margin 150 each re-performance. Eventually the simultaneous margin 150 for the missed pending event will be large enough to incorporate the previous pending event.

PENDING NOTES PROCESSOR 124

Referring back to FIG. 3, the pending notes processor 124 matches pending events to player gestures 36 from the controller 6, and sends note output commands 38 to the music synthesizer 18.

Referring again to FIG. 5A, the pending notes processor 124 determines the type of gesture, called a pending event 164, expected by the pending events. If the pending events will turn off all the notes currently on, a STOP 164*a* gesture is required. If currently there are no notes are on and the pending events will start one or more notes, a START gesture 164*b* is required. If at least one note is on and the pending events will leave at least one note on, a STOP-START 164*c* is required.

If the player gesture 36 received by the pending events processor 124 matches the pending event 164, all the note events in the pending events processor 124 are output to the music synthesizer 18 in the order and timing specified by the score 4, preserving the integrity of the music. This is most apparent in FIG. 5B where note output commands 38*d*, 38*e*, and 38*f* are started with one START player gesture 36*d*, and are output in the same order and in the same relative timing as scored notes 128*d*, 128*e*, and 128*f*.

When the pending event 164 does not match the player gesture 36, the preferred actions are a) if the player gesture 36 is a STOP, all sound .stops or b) if the player gesture 36 is a START and there is no pending NOTE ON event, the last notes on are turned on again (REATTACHED) The logic of the pending events processor 124 is summarized in Table 4.

TABLE 4

PENDING EVENTS PROCESSOR LOGIC

| Case No. | Pending Events 164 | Player Gesture 36 | Pending Note Action |
|---|---|---|---|
| 1. | STOP | STOP | STOP all notes that are on |
| 2. | STOP | START | Not Possible |
| 3. | STOP | STOP-START | REATTACK current notes on |
| 4. | START | STOP | Not Possible |
| 5. | START | START | START pending NOTE ON events |
| 6. | START | STOP-START | Not Possible |
| 7. | STOP-START | STOP | STOP all notes that are on |
| 8. | STOP-START | START | START pending NOTE ON events |
| 9. | STOP-START | STOP-START | STOP-START |

In case 3, REATTACK means STOP then START all the notes that were on, without advancing to the next pending events group. Cases 2, 4, and 6 are not possible due to the principles that only a START can come after a STOP and that all the pending events in a pending events group must be processed before a new pending events group is collected and processed. Case 2 is not possible since a START player gesture 36 can only follow a STOP which would not have satisfied the previous pending gesture 164 which could only have been a START or STOP-START, since the current pending gesture 164 is a STOP. Case 4 is not possible for the previous pending gesture 164 could only have been a STOP, satisfiable only by a STOP player gesture 36, and it is impossible to have two sequential STOP player gestures 36. In case 6, the previous pending gesture 164 could only have been a STOP (case 3), causing a REATTACK without advancement to the next pending events group. If case 7 occurs, it will always be followed by case 8, completing the pending events in the pending events group.

RUBATO PROCESSOR 126

Referring back to the detailed block diagram of the scheduler 28 in FIG. 3, the rubato processor 126 compares the time of the first pending note event in the pending notes processor 124 to the player gesture 36, and sends a tempo change command 40 to the accompaniment sequencer 42. Referring to FIG. 5A, in a preferred embodiment, the rubato processor 126 generates a time margin, called a rubato window 170, for all START and STOP-START pending event gestures 164. The rubato window 170 can be used to limit how much tempo change a player gesture 36 can cause, and determine when pending events in the pending notes processor 124 will be sent automatically to the music synthesizer 18.

The rubato window 170 is centered about the time of the first pending event, with a duration equal to a percentage (e.g. 20%) of the duration of the longest note in the pending events. If a player gesture 36 occurs within a rubato window 170 a tempo change command 40 is calculated and sent to the accompaniment sequencer 42. The tempo change is calculates as follows;

tempo change=first pending event time–player gesture time

In a preferred embodiment, tempo is changed when a player gesture 36 occurs outside of a rubato window 170 but is limited to a maximum (clipped) value. Tempo is not updated on a STOP player gesture 36 since the start of a note is more musically significant. In an alternate embodiment, tempo is not updated when a player gesture 36 occurs outside of a rubato window 170.

If no player gesture 36 is received by the end of a rubato window 170 and both a START and a STOP pending event is present in the pending notes processor 124, the pending events are processed as if a player gesture 36 was received at the end of the rubato window 170. This is called a forced output. This feature of the invention covers for lapse of attention by the player, preventing the player from getting too far behind the other players or the accompaniment sequencer 42.

If a START and STOP pending event is not present, an output is not forced since it would be unmusical to stop all notes while a player is playing or start a note when the player is not playing.

To protect against the player gesturing too early and starting note events prematurely, a time point 178 is set between the current rubato window 170*g* and the previous rubato window 170*d*. In one embodiment the time point 178 can be set at 50%. In a preferred embodiment the time point 178 is varied by commands placed in the score. If a START or STOP-START player gesture 36 is received before the time point 178, all the current notes on are REATTACHED and the pending events are unaffected. If a player gesture 36 of any type is received after the time point 178, or a player gesture 36 of STOP type is received at any time, the player gesture 36 is applied to the current pending events. If the player gesture 36 occurs before the rubato window 170, the value of the tempo change command. 40 is limited to the maximum positive (i.e. speed up tempo) value.

The rubato window 170 can be set by the player as a percentage ("the rubato tolerance") of the duration of the longest note occurring in the pending event. In a preferred embodiment the rubato window 170 is set by commands placed in the score 4. A large rubato tolerance will allow a player to take great liberty with the timing and tempo of the piece. A rubato tolerance of zero will reduce the invention to that of a player piano, where the note events are played at exactly the times specified in score 4, and the player and controller 6 will have no effect on the timing of the piece of music. A student may use this feature to hear how a piece is intended to be performed.

EXAMINATION OF NOTE SCHEDULER TIMING

Referring to FIG. 5A, the scored notes 128 shall now be examined in detail to review the actions of the scheduler 28. The START play gesture 36*a* arrives slightly early but within the rubato window 170*a* so note output command 38*a* is started, with a positive tempo change 40*a*. The STOP player gesture 36*aa* stops note output command 38*a*, much earlier than specified by the score 4. Tempo is never updated on a STOP event. Note output command 38*b* is started by a START player gesture 36*b* before the rubato window 170*b* so the tempo change 40*b* is limited to the maximum positive value. In an alternate embodiment, which only allows pending events to be processed inside rubato windows 170, the start of note output command 38*b* would have been postponed until the beginning of the rubato window 170*b*.

By the end of the rubato window 170*c* no player gesture 36 has been received so the start of note output command 38*c* has been forced and, in the time interval specified by the score 4, note output command 38*b* has ended. The STOP-START player gesture 36*c*, corresponding to case 3 of Table 4, generates a REATTACK of note output command 38*cc*, which the STOP player gesture 36*cc* ends. The scored notes 128*d*, 128*e*, and 128*f*, are started by the START player gesture 36*d*, within the rubato window 170*d*, and slightly early, so a positive tempo command 40*d* is issued. The STOP-START player gesture 36*dd* falls before the 50% time point 178, so note output command 38*f* is REATTACHED as note output command 38*ff*. Without the time point 178 feature, note output command 38*f* would have stopped abruptly and note output command 38*g* would have started very early. No player gesture 36 was detected within the next rubato window 170*g* so note output command 38*g* was forced to start at the end of the rubato window 170*g* and the maximum negative tempo change 40*g* sent. The STOP-START player gesture 36*f* stopped note output command 38*ff*. The next STOP-START player gesture 36*h* started note output command 38*h*, and the last STOP player gesture 36*hh* stopped note output command 38*h*. Notice that note output command 38*g* stops after note output command 38*h* stops, as specified by the score 4.

Figure 6A:
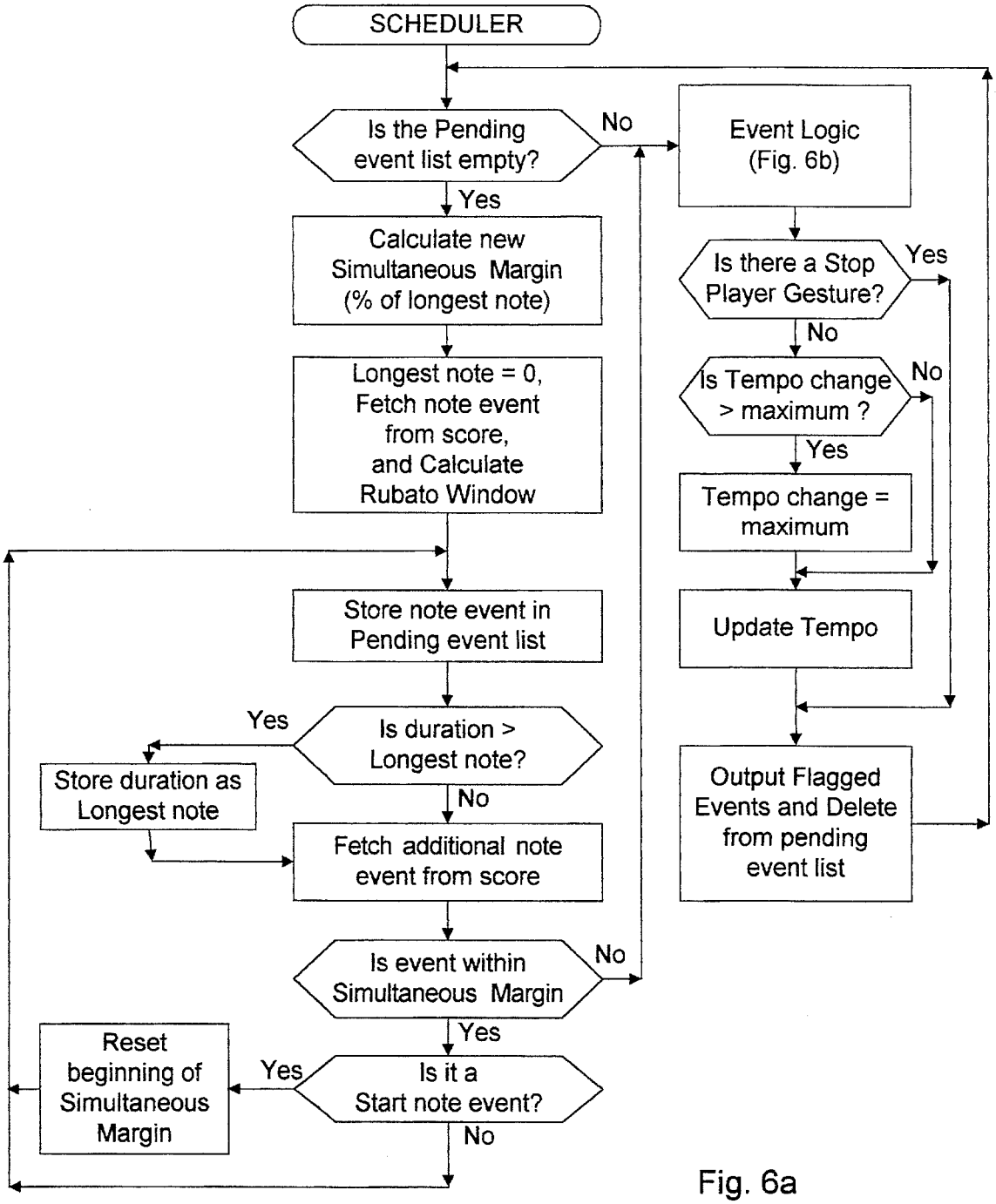
FIG. 6A and 6B illustrates by means of a flow chart the operation of the scheduler.
Figure 6B:
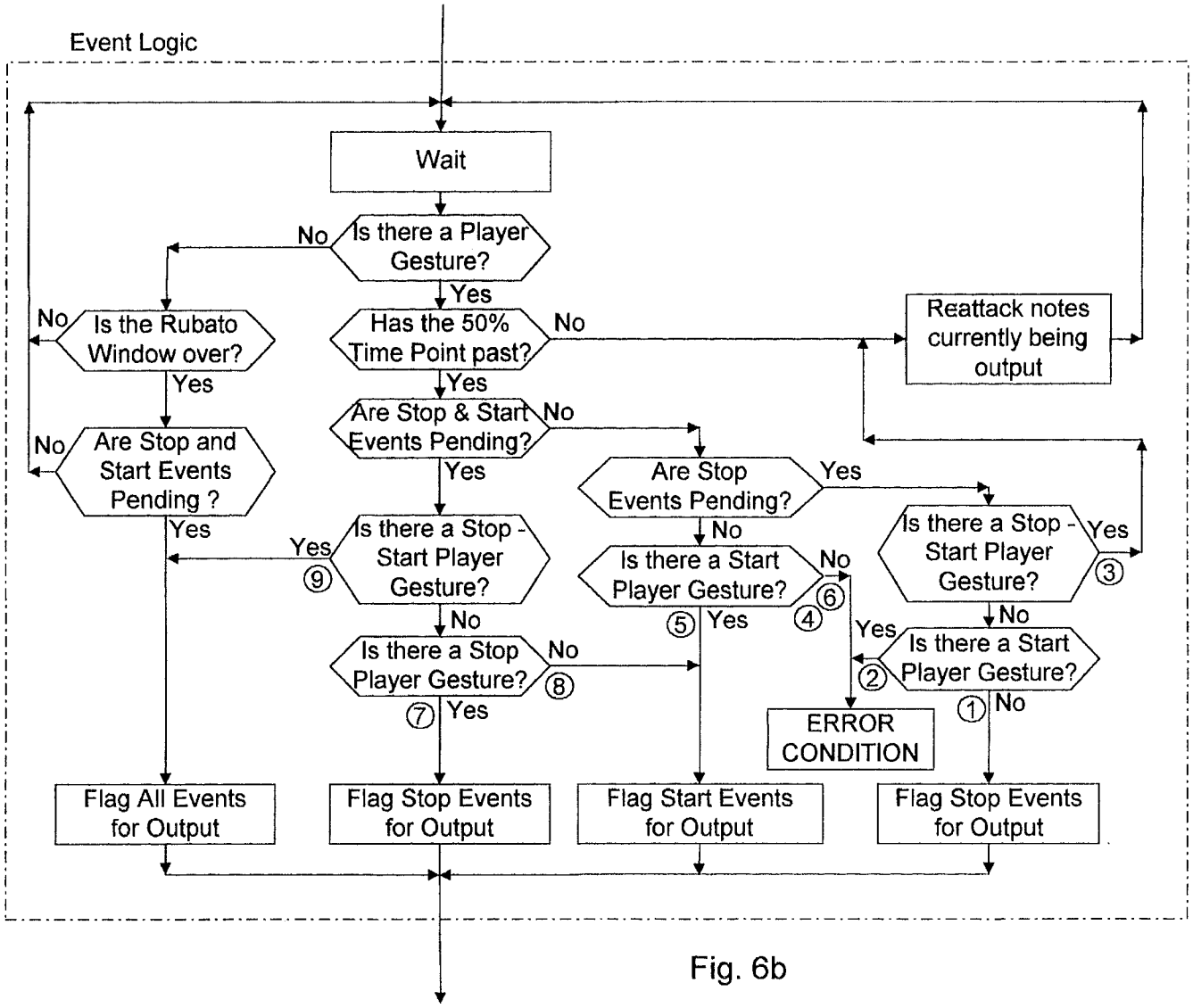

FIG. 6A and 6B illustrates by means of a flow chart the preferred operation of the scheduler previously described and illustrated in FIG. 5A and FIG. 5B. The pending events processing logic case numbers listed in Table 4 are referred to in the flow chart by encircled numbers.

ACCOMPANIMENT SEQUENCER 42

Referring back to the detailed block diagram of FIG. 3, the accompaniment sequencer 42 contains a conventional sequencer 226 whose tempo can be set by external control 228. The function of the sequencer 226 is to select notes, and in a preferred embodiment expression commands, from the accompaniment channel(s) of the score 4 and send accompaniment note and expression commands 227 to the music synthesizer 18 at the times designated in the score 4, and at a pace determined by the tempo clock 230. In a preferred embodiment, time in the score 4 is not an absolute measurement (e.g. seconds) but a relative measurements ticks or beats). The tempo determines the absolute value of these relative time measurements. Expressions for tempo include ticks per second and beats per minute.

The tempo clock 230 can manually be changed by the player, for example by a knob (not shown), or automatically changed by tempo commands in the score, or changed by tempo change commands 40 from a scheduler 28. If the tempo is to be changed by a scheduler 28, the tempo selector 232 selects one of the schedulers 28,30,32,34 as the source of tempo change commands 40. For the case of the preferred embodiment of FIG. 1, the tempo selector 232 is a one-pole-four-throw switch, set by a tempo selector command 233 in the score 4.

In string quartet music, for example, it is common for tempo control to pass among several players. The first violinist may start controlling the tempo, then pass tempo control to the cellist during a cello solo. In this case, it would be preferred for the score 4 to contain tempo selector commands each time tempo control changes hand. Typically the controller playing a lead or solo role in the music is given control over the tempo.

In a preferred embodiment, the time base for the invention is based on a clock whose frequency is regulated by tempo. The faster the tempo, the faster the clock frequency. In this way all time calculations and measurements (e.g. simultaneous margins 150, rubato window 170, note durations, time between notes) do not have to change as tempo changes, saving a good deal of calculation and making the software easier to implement.

MUSIC RE-PERFORMANCE EDITOR

A re-performance of the score 4 can be recycled by recording the output of the music re-performance system and using the recorded output as the score 4 in another re-performance. The recording can be implemented by replacing the music synthesizer 18 with a conventional sequencer program. In a preferred embodiment, two copies of the score 4 are kept, one is read as the other one is written. If the player is happy with a particular re-performance, the scores 4 are switched and the particular re-performance is used as the one being read. Recycling the score 4 produces a cumulative effect on note timing changes, allowing note timing over several re-performance generations to exceed the note timing restrictions imposed by the rubato window 170 for a single re-performance.

To edit expression commands of a score 4 without effecting the timing of the piece, the rubato window 170 is set to zero and the output of the re-performance is stored. To selectively edit expression commands stored in the score 4, the expression processor 120 blocks all non-selected expression commands 44 from leaving the controller 6. To change only note timing information, all expression commands 44 are blocked. In a similar manner, any combination of note timing and expression commands can selectively be edited.

POLYGESTURAL SCHEDULER 34

Figure 7:
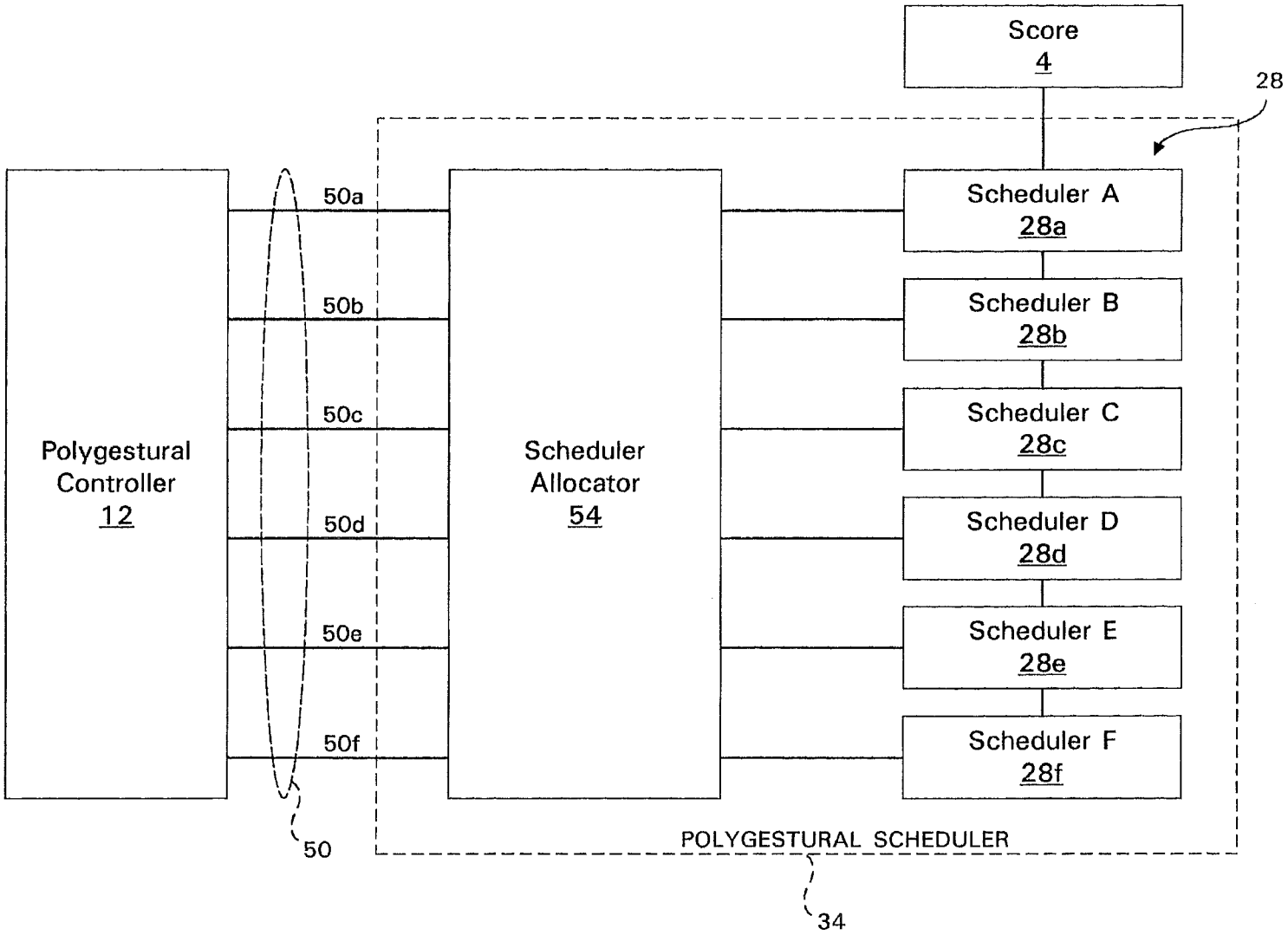
FIG. 7 is a schematic block diagram of an embodiment of a polygestural scheduler capable of processing a plurality of simultaneous input gestures.

FIG. 7 illustrates how schedulers 28 can be combined to create a polygestural scheduler 34 capable of handling polyphonic instruments that produce multiple gestures. Some controllers are intrinsically monophonic, that is can only produce one note at a time, like a clarinet or flute. For these controllers, the monogestural scheduler 28 shown in the detailed block diagram FIG. 3 is sufficient. Others instruments, like a violin and guitar, are polyphonic and require a scheduler capable of processing multiple simultaneous gestures. Referring to FIG. 7, a polygestural controller 12, for example a guitar controller, with six independent gesture outputs 50 is connected to a polygestural scheduler 34 which contains six schedulers 28*a–f*. The scheduler allocator 54 receives the gestures 50 from the polygestural controller 12 and determines how many schedulers 28 to allocate to the polygestural controller 12.

In a preferred embodiment of a polygestural scheduler 34 for guitar, the score 4 contains seven channels of guitar music. One channel of the score 4 contains melody notes. The other six channels contain chord arrangement, one channel of notes for each string of the guitar. Various allocation algorithms can be used to determine the routing of controller gesture outputs 50 to schedulers 28. In a preferred embodiment one of two modes is established; LEAD or RHYTHM. In LEAD mode all gesture inputs 50 are combined and routed to one scheduler 28*a* that is assigned to the lead channel. In RHYTHM mode each gesture input 50 is routed to an individual scheduler 28, and each scheduler 28 is assigned to individual score 4 channels.

In order to show the operation of the preferred embodiment of the ploygestural scheduler 34 for guitar using the preferred scheduler allocation 54 algorithm, in the context of the embodiment of the music re-performance system 2 illustrated in FIG. 1, Score 2 MIDI channels must be assigned to each controller 6, 8, 10, 12. A typical channel assignment is presented in Table 5.

TABLE 5

CONTROLLER CHANNEL ASSIGNMENT

| Controller | | Score | |
|---|---|---|---|
| Name | Number | Channel | Timbre |
| Violin | #1 | 1 | Violin |
| Cello | #2 | 2 | Cello |
| Flute | #3 | 3 | Flute |
| Guitar | #4 | 4 | Lead Guitar |
| | | 5 | Rhythm Guitar String #1 |
| | | 6 | Rhythm Guitar String #2 |
| | | 7 | Rhythm Guitar String #3 |
| | | 8 | Rhythm Guitar String #4 |
| | | 9 | Rhythm Guitar String #5 |
| | | 10 | Rhythm Guitar String #6 |
| Accompaniment | | 11 | Bass guitar |
| | | 12 | Piano |
| | | 13 | Clarinet |
| | | 14 | Snare drum |
| | | 15 | High-hat drum |
| | | 16 | Bass drum |

Table 6 illustrates the operation of the scheduler allocator 54, in LEAD and RHYTHM mode, which assigns gesture inputs 50 to schedulers 28, and assigns schedulers 28 to score 4 MIDI channels.

TABLE 6

SCHEDULER ASSIGNMENT

| Gesture | LEAD MODE | | RHYTHM MODE | |
|---|---|---|---|---|
| 50 | Scheduler 28 | Score 4 Ch. | Schedule 28 | Score 4 Ch |
| 50a | 28a | 4 | 28 a | 5 |
| 50b | 28a | 4 | 28b | 6 |
| 50c | 28a | 4 | 28c | 7 |
| 50d | 28a | 4 | 28d | 8 |
| 50e | 28a | 4 | 28e | 9 |
| 50f | 28a | 4 | 28f | 10 |

Various methods can be used to determine the mode of the scheduler allocator 54. In one embodiment a simple switch (not shown) mounted on the controller 12, having two positions labeled LEAD and RHYTHM, allows the player to manually set the mode. In another embodiment, the scheduler allocator 54 automatically selects the mode by determining if a single string or multiple strings are being played. In one implementation of this embodiment, a short history of string activity (i.e. gesture outputs 50) is analyzed. If a single string is plucked several times in succession (e.g. three, for example the string sequence 2,2,2 or 5,5,5), LEAD mode is selected. If an ascending or descending sequence of a number of strings (e.g. three, for example the sequence of strings 2,3,4 or 6,5,4) is plucked, RHYTHM mode is selected. If neither condition is met, the mode is not changed.

In a preferred embodiment (not shown) the controller 12 sets the mode of the scheduler allocator 54 by determining the location of the player's hand on the finger board. If the player's hand is high on the neck (towards the bridge), the controller 12 sets the scheduler allocator 54 mode to LEAD. If the player's hand is low on the neck (towards the nut),, the controller 12 sets the scheduler allocator 54 mode to RHYTHM. These gestures of playing lead high up on the neck and playing rhythm low down on the neck are part of the natural guitar gestural language most familiar to non-musicians.

A polygestural scheduler 34 can contain any number of schedulers 28. Typically the number of schedulers 28 in a polygestural scheduler 34 is equal to the number of sound producing elements on the instrument (e.g. bass guitar and violin=4, banjo=5, guitar=6).

STRING CONTROLLER 236

Figure 8:
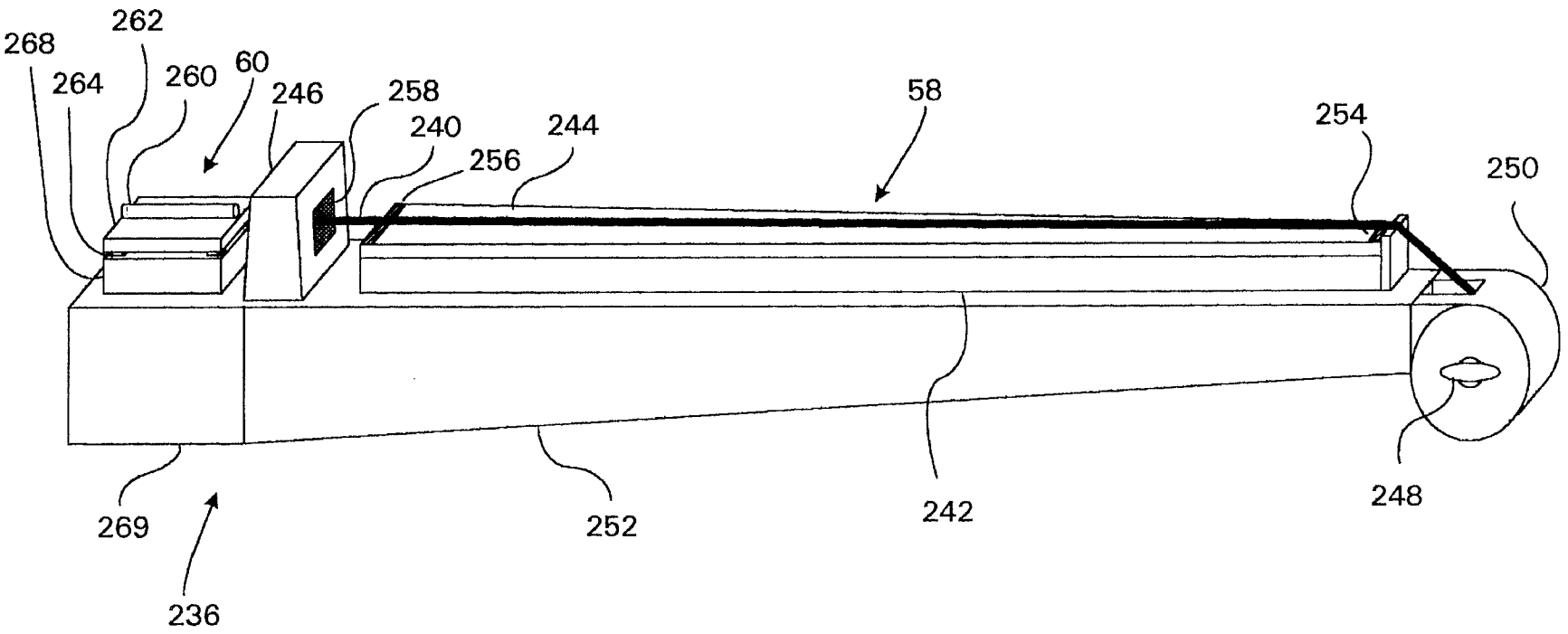
FIG. 8 is a perspective view of an embodiment of a string controller preferred for bowing.

FIG. 8 shows a string controller 236 capable of detecting energy and finger manipulation with an energy transducer 60 preferred for bowing. In one embodiment of the invention four controllers are used to play string quartets, consisting of a two violins, a viola, and a cello. In an alternate embodiment of the invention guitar and bass guitar controllers are used to play rock music. MIDI controllers exist for these instrument but are very costly since they are designed to generate pitch of acoustic quality, and typically employ pitch trackers, both of which are unnecessary and not used in the present invention.

A preferred embodiment of the music re-performance system 2 includes a string controller 236 which can be bowed and plucked, like a violin, or picked and strummed, like a guitar. The string controller 236 allows the ,use of common inexpensive sensor and signal processing techniques to reduce the cost of string controllers and allow interface to many hardware platforms. The string controller 236 is based on the controller model presented in the block diagram of FIG. 3. Two finger transducers 58 and four energy transducers 60 are examined, along with the signal processing required for them.

PREFERRED FINGER TRANSDUCER 58

Referring to FIG. 8, the preferred finger transducer 58 consists of one or more metallic strings 240 suspended above a finger board 242 covered with a semiconductive material 244, such as a semiconductive polymer, manufactured by Emerson-Cumings, Inc. (Canton, Mass.) as ECCOSHIELD (R) CLV (resistivity less than 10 ohm-cm), or by Interlink Electronics (Santa Barbara, Calif.). Use of a string 240 as part of the finger transducer 64 gives a realistic tactile experience and its purpose is instantly recognizable to the player. The string 240 terminates at one end in a rigid block 246, taking the place of a bridge. The other end of the string 240 terminates in a tuning peg 248 at the head 250 of the neck 252. Tension in the string 240 is required to keep the string 240 from touching the semiconductive material 244. A spring can be used (not shown) as an alternative to the tuning peg 248 to provide tension in the string 240. Electrical contacts are made at each end of the semiconductive material 244, at the top finger board contact 254 and bottom finger board contact 256, and at one end Of the string 240, the string contact 258. When a finger presses the string 240 onto the semi-conductive material 244, an electric circuit is made between the string 240 and the semiconductive material 244. The position of string 240 contact to the semiconductive material 244 is determined by the relative resistance between the string contact 258 to the top finger board contact 254, and the string contact 258 to the bottom finger board contact 256.

As finger pressure is applied to the string 240, the contact resistance between the string 240 and the semiconductive material 244 decreases. Finger pressure is determined by measuring the resistance between the string 240 and the semiconductor material 244.

For blown instruments the preferred finger transducers 58 are switches (not shown) which are electronically OR'ed together, so that a finger gesture 96 is produced whenever any switch is pressed or lifted. Force sensing resistors are preferred switches for they can measure finger contact and pressure. A force sensing resistor, manufactured by Interlink Electronics, is a semiconductive polymer deposit sandwiched between two insulator sheets, one of which includes conductive interdigiting fingers which are shunted by the semiconductive polymer when pressure is applied. The semiconductive polymer can also be used as the semiconductive material 244.

ALTERNATE FINGER TRANSDUCER

An alternate finger transducer (not shown) is electrically equivalent to the preferred finger transducer 58 and is commercially available as the FSR Linear Potentiometer (FSR-LP) from Interlink. One version of the FSR-LP is 4" long and ¾" wide, suitable for a violin neck. Larger sizes can be made for other controllers, including violas, cellos, basses, and guitars. The force sensing resistor sensors are prefabricated and hermetically sealed so the internal contacts never get dirty, the surface is waterproof and can be wiped clean of sweat and other contaminants, the operation is stable and repeatable over time, and the sensors are very durable. The force sensing resistor sensor is under 1 mm. thick and has negligible compression and provides no tactile feedback. To compensate, a compressible material such as rubber or foam can be place over or under the force sensing resistor to give some tactile response.

PREFERRED ENERGY TRANSDUCER 60

The energy transducer 60 of the preferred embodiment consists of a textured rod 260 attached to a floating plate 262 suspended by four pressure sensors 264. The four pressure sensors 264 are mounted to a flat rigid platform 268. The body 269 of the string controller 236 can substitute for the flat rigid platform 268. As a bow (not shown) is dragged across the textured rod 260, forces are applied to the pressure sensors 264.

Figure 9B:
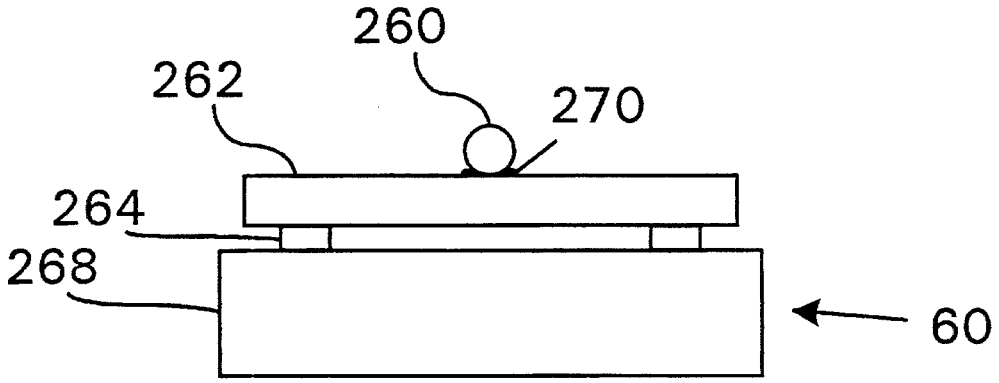
FIG. 9B is a side view of the energy transducer of FIG. 9A.
Figure 9A:
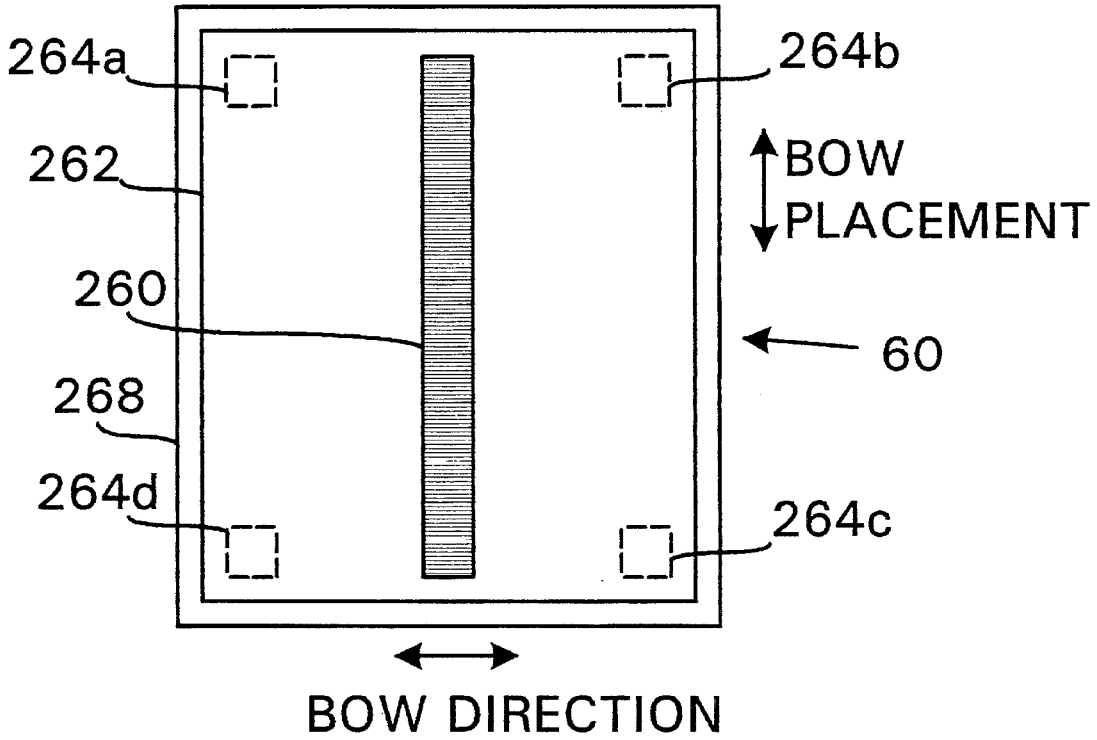
FIG. 9A is a perspective view of an energy transducer preferred for bowing used in the string controller shown in FIG. 8.

FIG. 9A and 9B show a detailed top and side view, respectively, of the energy transducer 60 preferred for bowing. The function of the textured rod 260 is to simulate the feel of a string, particularly when bowed. An embodiment of the textured rod 260 is a threaded ¼ diameter steel rod with 20 threads per inch. The grooves give a good grabbing feeling as the bow is dragged across, though the pitch from the threads tends to force the bow off the normal to the rod. This ,can be corrected by sequentially scoring a rod (i.e. non-threaded). Other materials that grip the bow can be used including plastic, rubber, wood, wool, and rosin. Other shapes include a wedge, channel, and rectangle. In a preferred embodiment, the textured rod 260 is fastened with glue 270 to the floating plate 262, as shown in FIG. 9B.

When a bow is drawn across the textured rod 260, the grabbing of the bow on the textured rod 260 generates forces on the floating platform 262, transmitting pressures to the pressure sensors 264*a*, 264*b*, 264*c*, and 264*d*. These four pressures are analyzed to determine the placement of bow on the textured rod 260, the bow pressure, and the bowing direction.

Pressure sensors 264 can include strain gauges, capacitance-effect pressure transducers, and piezo-ceramic transducers. A preferred embodiment uses force sensing resistors. The force sensing resistors are under 1 mm. thick and do not appreciably compress. Pads (e.g. foam) (not shown) can be added between the floating plate 262 and the platform 268 to give the sensation of a pliable string.

ALTERNATE ENERGY TRANSDUCERS 60

Figure 10B:
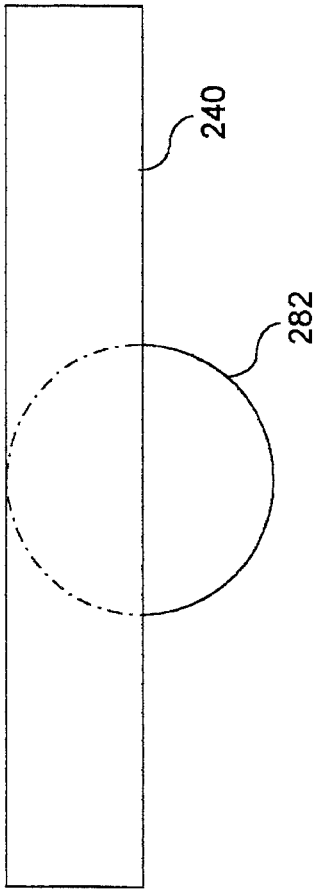
FIG. 10B is a side view of a detail of FIG. 10A, showing the optical aperture of the optointerrupter partially eclipsed by a string.
Figure 10A:
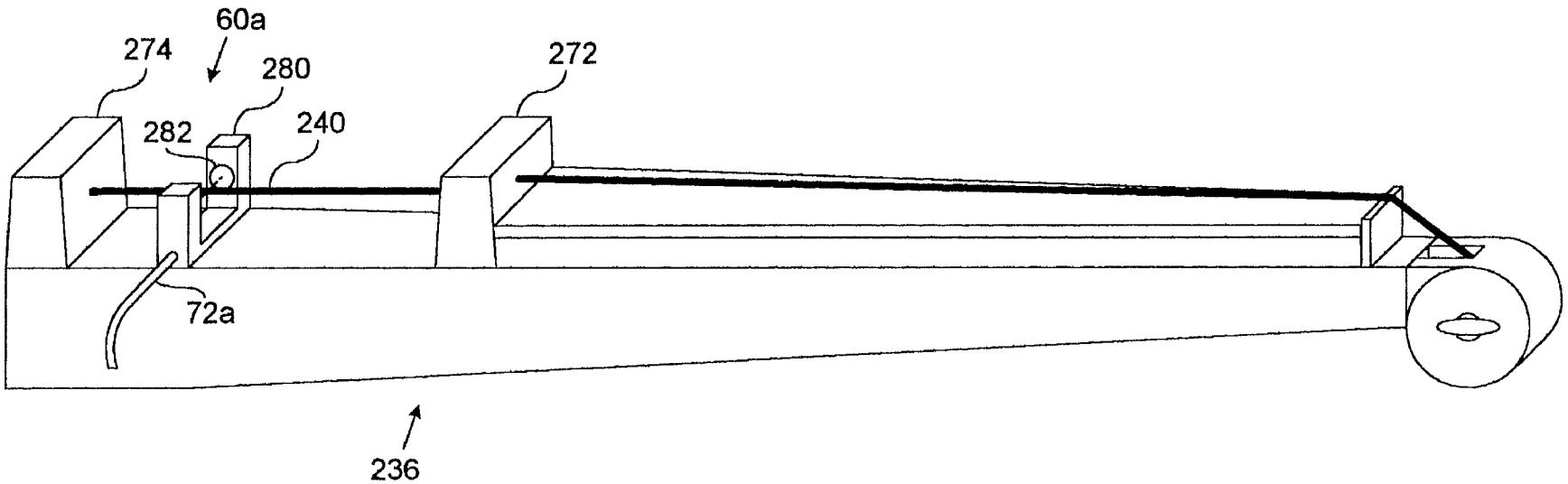
FIG. 10A is a perspective view of an alternate embodiment of a string controller using an optical interrupter to measure string vibrations.

FIG. 10A shows a string controller 236 using an optical beam 282 to measure string vibrations. A string 240 is placed between an upper block 272 and a lower block 274. The blocks 272 and 274 are preferably made of an acoustic damping material like rubber to prevent string 240 vibrations from reaching the sound board (not shown) of the string controller 236. An optical interrupter 280 (e.g. Motorola H21A1) is placed near the lower block 274, such that the string 240 at rest is obscuring nominally half of the light beam 282 of the optical interrupter 280, as illustrated in the cross section view of the optical interrupter 280 shown in FIG. 10B. When the string 240 is bowed, plucked, picked, or strummed, string 240 vibrations modulate the light beam 282 of the optical interrupter 280, producing an oscillating electrical output 72*a* indicating string energy. If the string 240 is made stiff enough, like a solid metal rod, one block 274 can be used, allowing the other end of the string 240 to vibrate freely. This is particularly useful for a guitar controller, since the string 240 would have a naturally long decay which the player could modify for greater expressive control. For example a common guitar gesture is to muffle the strings with the side of the plucking hand. The expression processor 120 could detect this condition by monitoring the decay time, and generate appropriate expression commands 44 accordingly. The optointerrupter 280 does not contact the string 240, measures string position, has a very fast response time (>10 Khz), is electrically isolated from the string, and produces an electric signal with a large signal-to-noise ratio.

Figure 11:
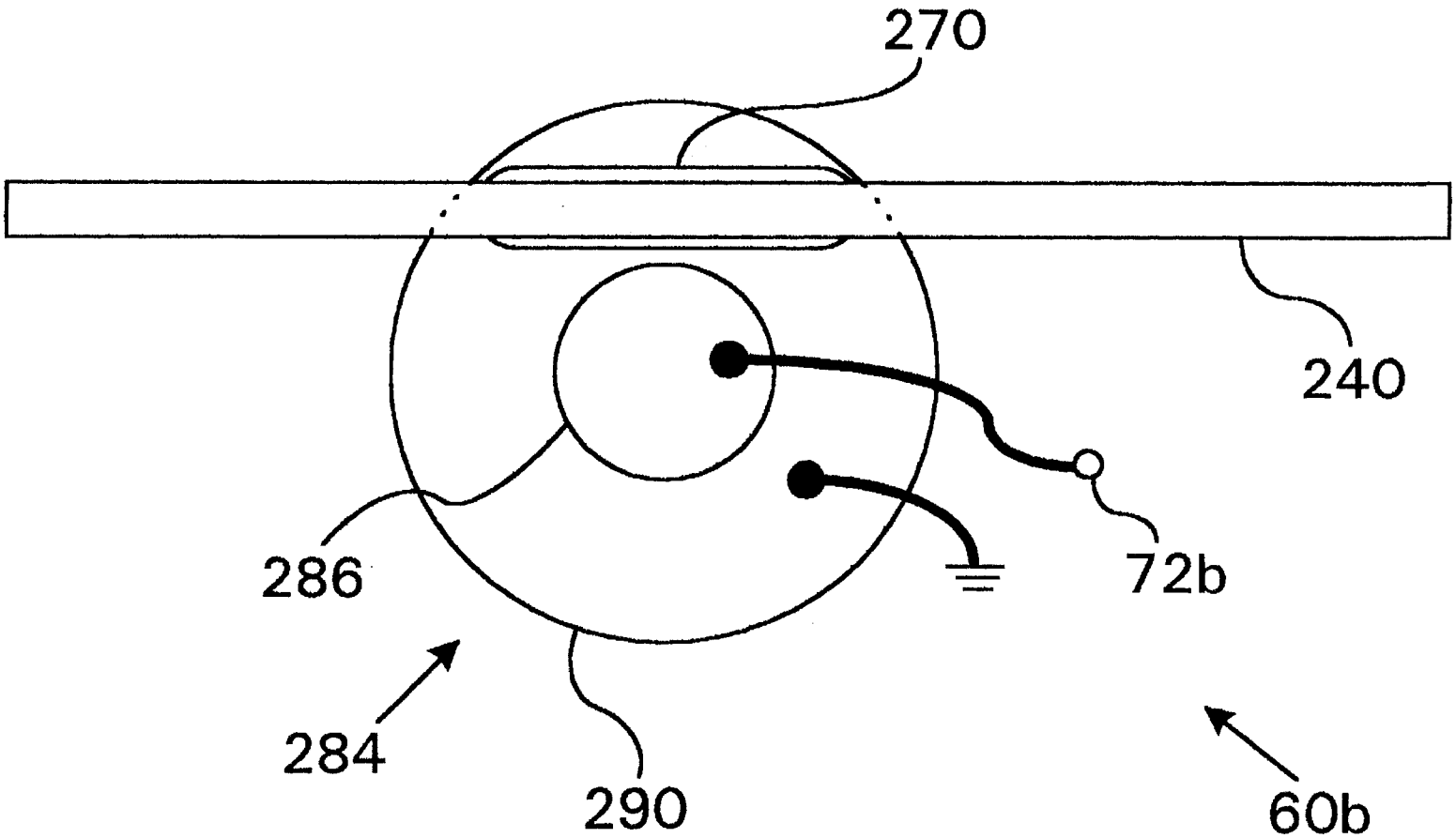
FIG. 11 is a perspective view of an alternate embodiment of a string energy transducer using a piezo-ceramic element to measure string vibrations.

FIG. 11 shows a detail of another method of measuring string vibration, using a piezo ceramic assembly 284. The piezo-ceramic assembly 284, mounted in a location similar to the optointerrupter 280 of FIG. 10A, consists of a piezo-ceramic element 286 attached to a brass disk 290. The brass disk 290 is placed in contact with the string 240, so that vibrations in the string 240 are mechanically transmitted to the piezo-ceramic assembly 284, producing an oscillating electrical output 72*b*, indicating string energy. In a preferred embodiment glue 270 is used to adhere the string 240 to the brass disk 290. The piezo-ceramic assembly 284 is very low cost, generates it's own electric signal, is an a.c. device so it does not need to be decoupled, generates a large signal, and has a very thin profile.

Figure 12:
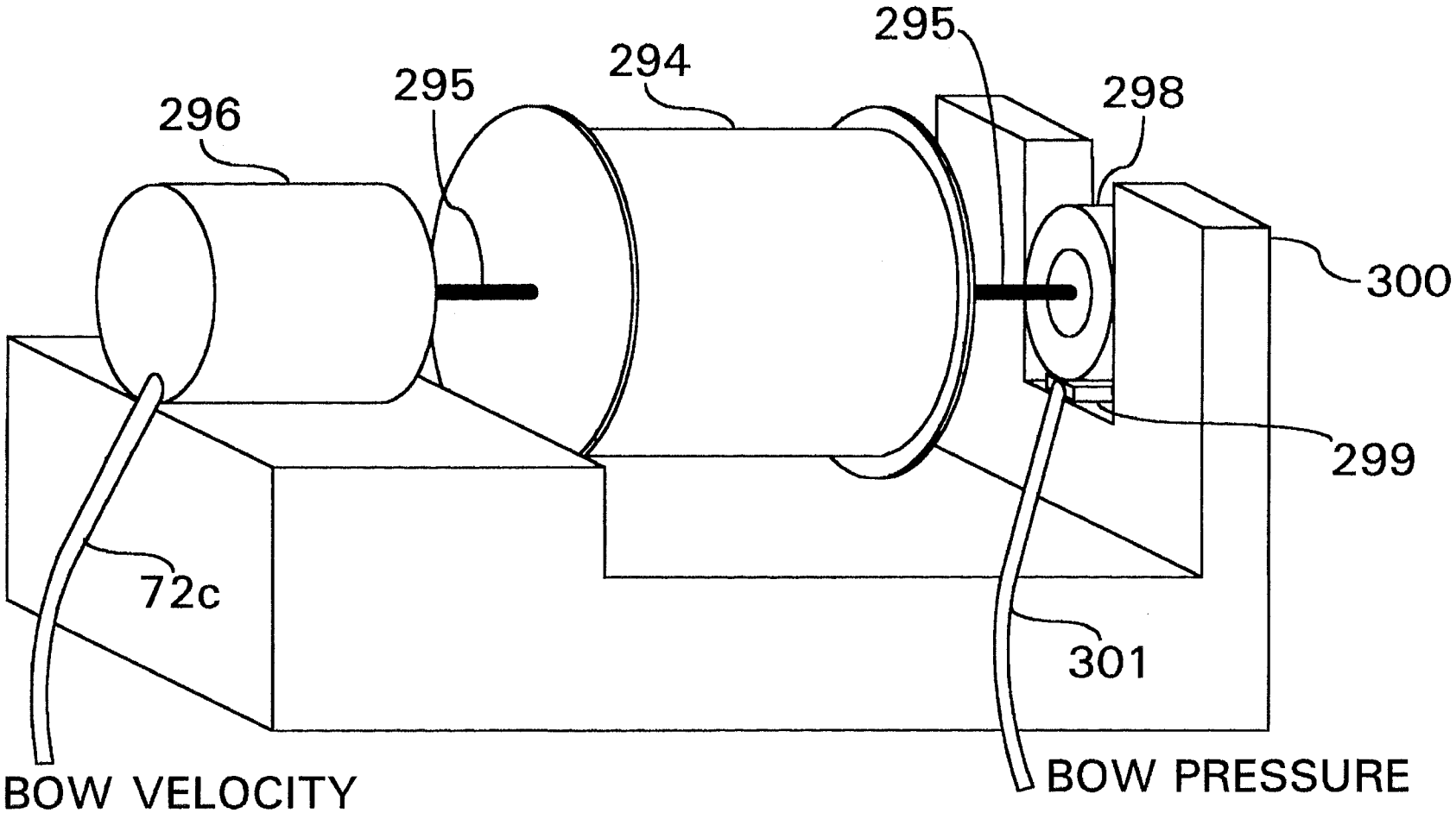
FIG. 12 is a perspective view of an alternate embodiment of a string energy transducer using a tachometer to measure bow velocity.

FIG. 12 shows a tachometer 296 used to measure bow velocity and direction. A spindle 294 is mounted on a shaft 295 that connects at one end to a tachometer 296, and at the other end to a bearing 298. When a bow is drawn across the spindle 294, the spindle 294 rotates, driving the tachometer 296 which produces an electric signal 72*c*, proportional to bow velocity. The side-to-side motion of the bearing 298 is constrained by a cradle 300, but is free to pass pressure applied from the bow to the spindle 294, to a bow pressure sensor 299, which measures bow pressure 301. A preferred bow pressure sensor 299 is a force sensing resistor.

In one embodiment the spindle 294 surface is covered with cloth thread to provide a texture for the bow to grab. The surface needs to grab the bow, as with the textured rod 260. Most material can be treated to make the surface rough enough to grab the bow. Some surface treatments and materials include knurled wood, sandpaper, textured rubber, and rough finished plastic. Examples of tachometers 296 include an optical encoder, such as those used in mice pointing devices, a permanent magnetic motor operated as a generator, a stepper motor operated as a generator, or any other device that responds to rotation. An embodiment of the string controller 236 uses a stepper motor (not shown) to allow previously recorded bow motions to be played back, much like a player piano. An alternate embodiment uses a motor as a brake, providing resistance to bow movement, simulating the friction and grabbing of a bow on a string.

PREFERRED FINGER SIGNAL PROCESSING 64

Figure 13:
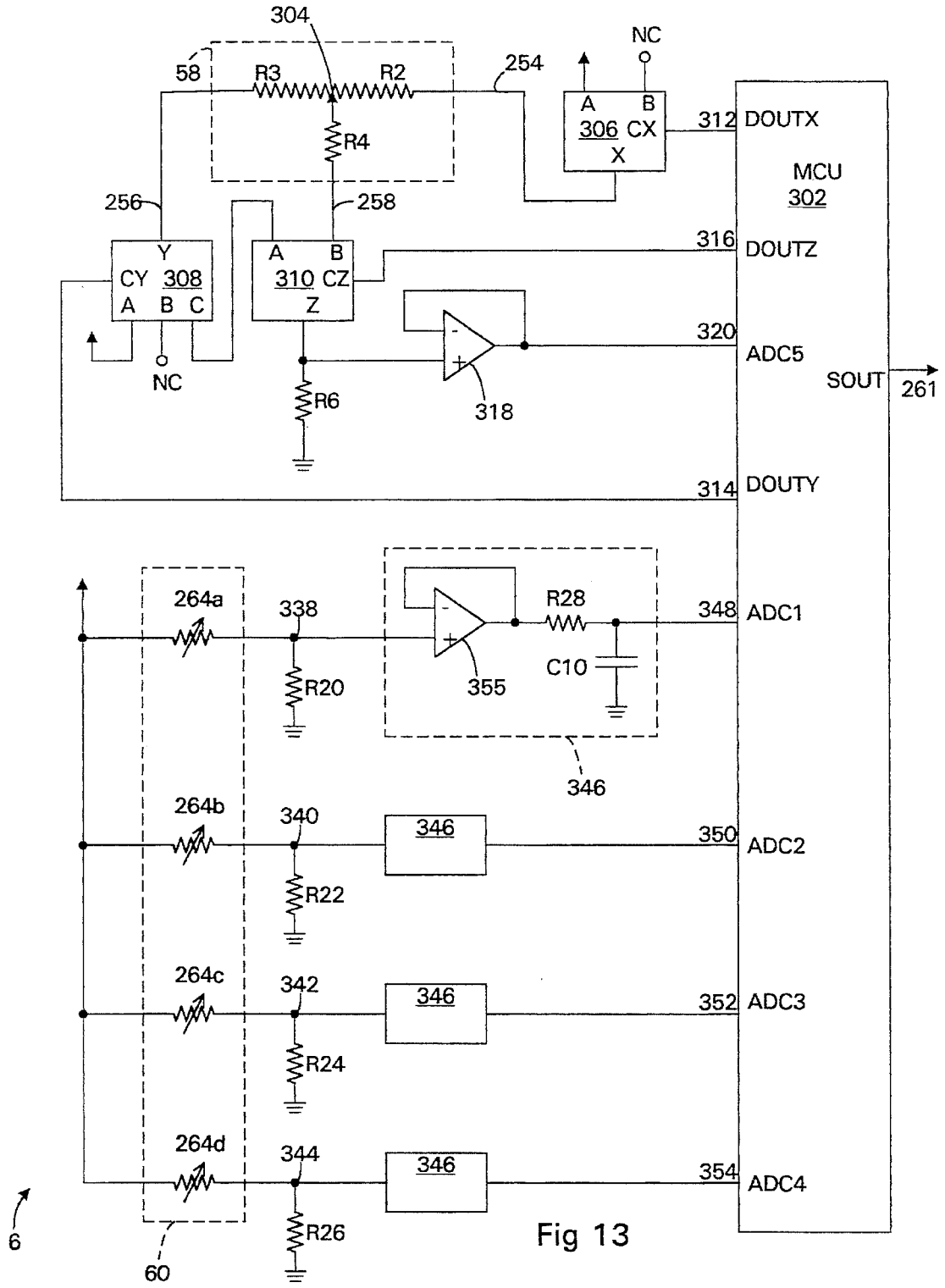
FIG. 13 is a schematic of an embodiment of controller electronics using the preferred energy and finger transducers illustrated in FIG. 8.

FIG. 13 show a schematic of an electronic circuit to perform all the signal processing necessary to implement a controller 6 using the preferred energy transducers 60 and finger transducers 58 of the string controller 236. Most of the signal processing required is performed in software in the microcomputer 302 (MCU) to minimize hardware. A 68HC11 manufactured by Motorola is used as the MCU 302 in the preferred embodiment since it is highly integrated containing a plurality analog-to-digital converts (ADC), digital inputs (DIN) and digital outputs (DOUT), and a serial interface (SOUT), as well as RAM, ROM, interrupt controllers, and timers. Alternate embodiments of the signal processing using simple electronic circuits are presented, eliminating the need for the MCU 302, and providing an inexpensive means of interfacing finger transducers 58 and energy transducers 60 to multi-media platforms.

The preferred finger transducer 58 is modeled as resistors R3, and R4. The semiconductive material 244 is modeled as two resistors R2 and R3 connected in series. The top finger board contact 254 connects to SWX 306, the bottom finger board contact 256 connects to SWY 308, and the string contact 258 connects to SWZ 310. The connection point 304 between R2, R3 and R4 represents the contact point between the semiconductive material 244 and the string 240. The .contact resistance between the string 240 and the semiconductive material 244 is represented by R4. The location of finger position along the length of the semiconductive material 244 is the ratio of R2 to R3. For example, when R2 equals R3 the finger is in the middle of the finger board 242. Finger pressure is inversely proportional to R4.

Switches SWX 306, SWY 308, and SWZ 310 (e.g. CMOS switch 4052), controlled by digital outputs DOUTX 312, DOUTY 314, and DOUTZ 316 of the MCU 302, respectively, arrange the finger transducer contacts 254, 256, 258 to make the resistance measurements listed in Table 7. Switch 306, 308, 310 configurations place the unknown resistances (R2, R3, or R4) in series with known resistor R6, producing a voltage, buffered by a voltage follower 318 (e.g. National Semiconductor LM324), which is digitized by ADC5 320. The unknown resistances are determined by the voltage divider equation;

voltage measured=supply voltage×(R unknown/R6)

TABLE 7

SWITCH SETTINGS FOR RESISTANCE MEASUREMENT

| SWX 306 | SWY 308 | SWZ 310 | Resistance Measured |
|---|---|---|---|
| A | B | B | R2 + R4 |
| B | A | B | R3 + R4 |
| A | C | A | R2 + R3 |

These equations are sufficient to determine the values of R2, R3, and R4. It is important that the resistance measurements be done within a short period of time (.e.g. 20 msec) from each other, since the resistance of the semiconductive material 244 (R2+R3) can decrease when a several fingers hold down a length of the string 240, electically shorting a portion of the semiconductive material 244.

PREFERRED ENERGY SIGNAL PROCESSING 74

Resistors 264*a*, 264*b*, 264*c*, and 264*d* form voltage divider networks with resistors R20, R22, R24, and R26, respectively, producing pressure voltages 338, 340, 342, and 344, respectively, proportional to pressure, since the resistance of force sensing resistors decrease with pressure. The pressure voltages 338, 340, 342, and 344 are buffered and filtered 346, to remove high frequency noise caused by the scratching action of the bow across the textured rod 260, and applied to the analog to digital converters ADC1 348, ADC2 350, ADC3 352, and ADC4 354 of the MCU 302. The voltage follower 355 provides the buffering and the combination of R28 and C10 provides the low-pass filtering.

Software inside the MPU 302 converts the low-passed pressure voltages 348, 350, 352, and 354: into bow pressure (BP), bow direction (BD), and the location of bow contact along the textured rod 260 (BC). The relationship between the pressure voltages 338, 340, 342, and 344 and BP, BC, and BD are complicated by the bow orientation angles and torques (twisting actions) introduced by bowing but can be simplified to a first order approximation by the following relationships:

| | | |
|---|---|---|
| Let | A = the pressure of force sensing resistor 264a | |
| | B = the pressure of force sensing resistor 264b | |
| | C = the pressure of force sensing resistor 264c | |
| | D = the pressure of force sensing resistor 264d | |
| | Bow Pressure | BP = A + B + C + D |
| | Bow Contact Position | BC = (A + B) − (C + D) |
| | Bow Direction | BD = (A + D) − (B + C) |

The platform 262 and the textured rod 260 have some weight, producing small pressure that can be compensated for by subtracting off the minimum pressure detected. Bow contact position is measured along length of textured rod 260, and is a signed value with zero equal to the center of textured rod 260. Bow direction is a signed value that is positive when the bow is moving towards the A and D force sensing resistors 264*a* and 264*d* and negative when moving towards the B and C force sensing resistors 264*b* and 264*c*.

A property of the preferred energy transducer 60 is the bow does not have to be moving to maintain an energy state 76, since a valid bow direction can be generated by statically bearing down on the textured rod 260. This can be advantageous for a player who runs out of bow during a long sustained note. Since changing directions will cause a STOP-START event and likely REATTACK or change the note, the player can pause the bow while maintaining pressure on the textured rod 260 to infinitely sustain a note.

If this attribute is undesirable, the low-pass filters (R28-C10) can be removed, and the unfiltered pressure signals 338, 340, 342, and 344 analyzed for scratching noise to determine bow movement. A preferred method of scratching noise analysis is to count the number of minor slope changes. The slope of a noisy signal changes frequently with small (minor) amplitude differences between slope changes. If the count of the minor slope changes exceeds a count threshold, the bow is moving. The value for the count and amplitude thresholds depend on a multitude of factors including the response characteristics of the pressure sensors 264*a–d*, the material of the textured rod 260, and the material of the bow. The count and amplitude threshold are typically determined empirically.

Figure 14:
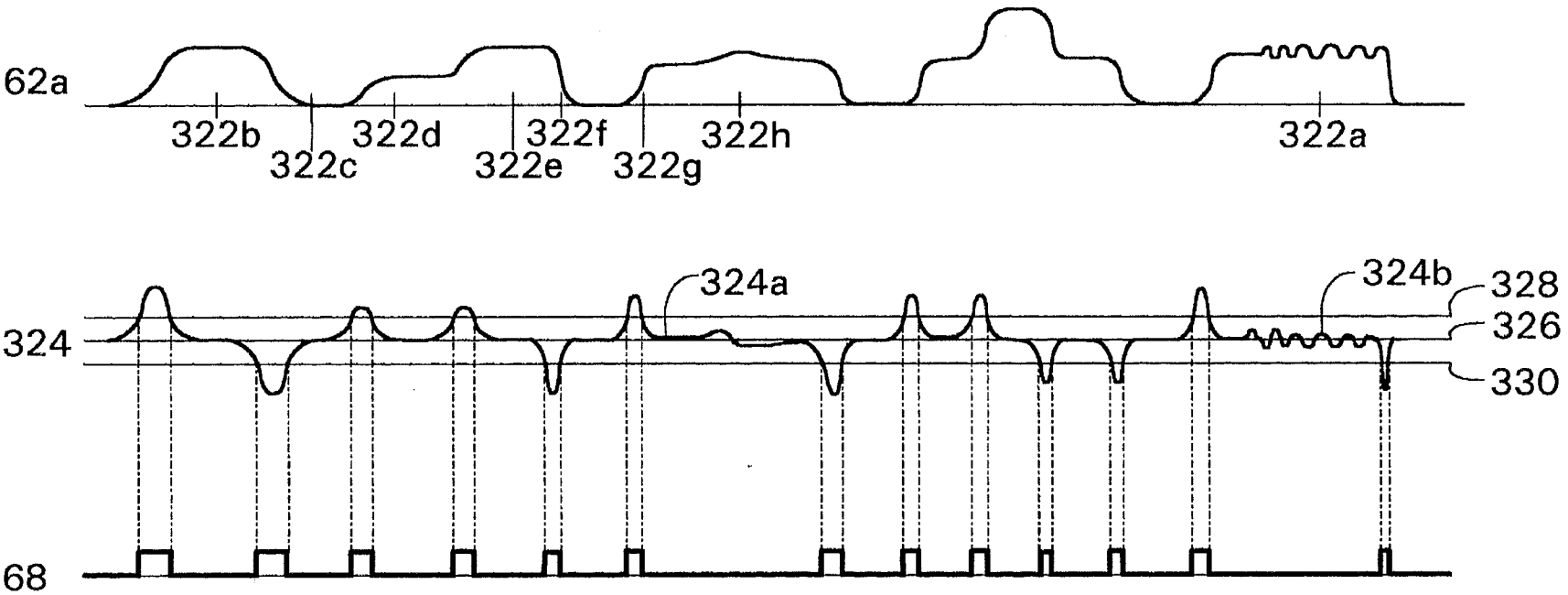
FIG. 14 illustrates with wave forms and timing diagrams the signal processing for the preferred finger transducer of FIG. 8.

FIG. 14 illustrates with wave form and timing diagrams the finger signal processing 64 necessary to determine finger state 68. Once the finger resistances are determined and digitized, the MCU 302 calculates finger position as R2/R3 and finger pressure as R4. To determine the finger state 68, the finger position 322 is differentiated, producing a slope signal 324 centered about zero 326. If the slope 324 exceeds a fixed positive 328 or negative 330 reference, a finger state 68 pulse is produced. The positive threshold 328 is equal in magnitude to the negative threshold 330. The magnitude of the thresholds 328, 330 determine the distance the fingers must move (or the trombone valve must slide) in order to generate a finger state 68 pulse. If the magnitude is set too small, wiggling fingers 322*a* will produce a finger state 68 pulse. If the magnitude is set too large, large finger spans will be necessary to generate finger state 68 pulses. The magnitude can be fixed or set by the player for their comfort and playing style, and in the preferred embodiment is set by a sensitivity knob (not shown) on the string controller 236. Player gesture 36 and expression commands 44 generated by the controller 6 hardware are sent through the serial output 261 (SOUT) to either the midi interface 16 or directly to the computer 14.

The history of the finger activity presented in FIG. 14 will now reviewed. The finger position signal 322 at time 322*b* indicates a finger is pressing the string 240 onto the semiconductive material 244. At time 322*c* the finger has released the string 240. At time 322*d* a finger presses the string 240 onto the semiconductive material 244, and at time 322*d* uses a second finger to place a higher portion of the string 240 onto the semiconductive material 244, which is released at 322*f*. At time 322*g* the string 240 is pressed to the semiconductive material 244 and slowly slid up semiconductive material 244 up through time 322*h*. Since this was a slow slide, the slope 324*a* was too small to cause a finger state 68 pulse. At time 322*a*, finger wiggling, probably intended as vibrato, is ignored since the slope signal 324*b* it produces is smaller than the thresholds 328 and 330.

Figure 15:
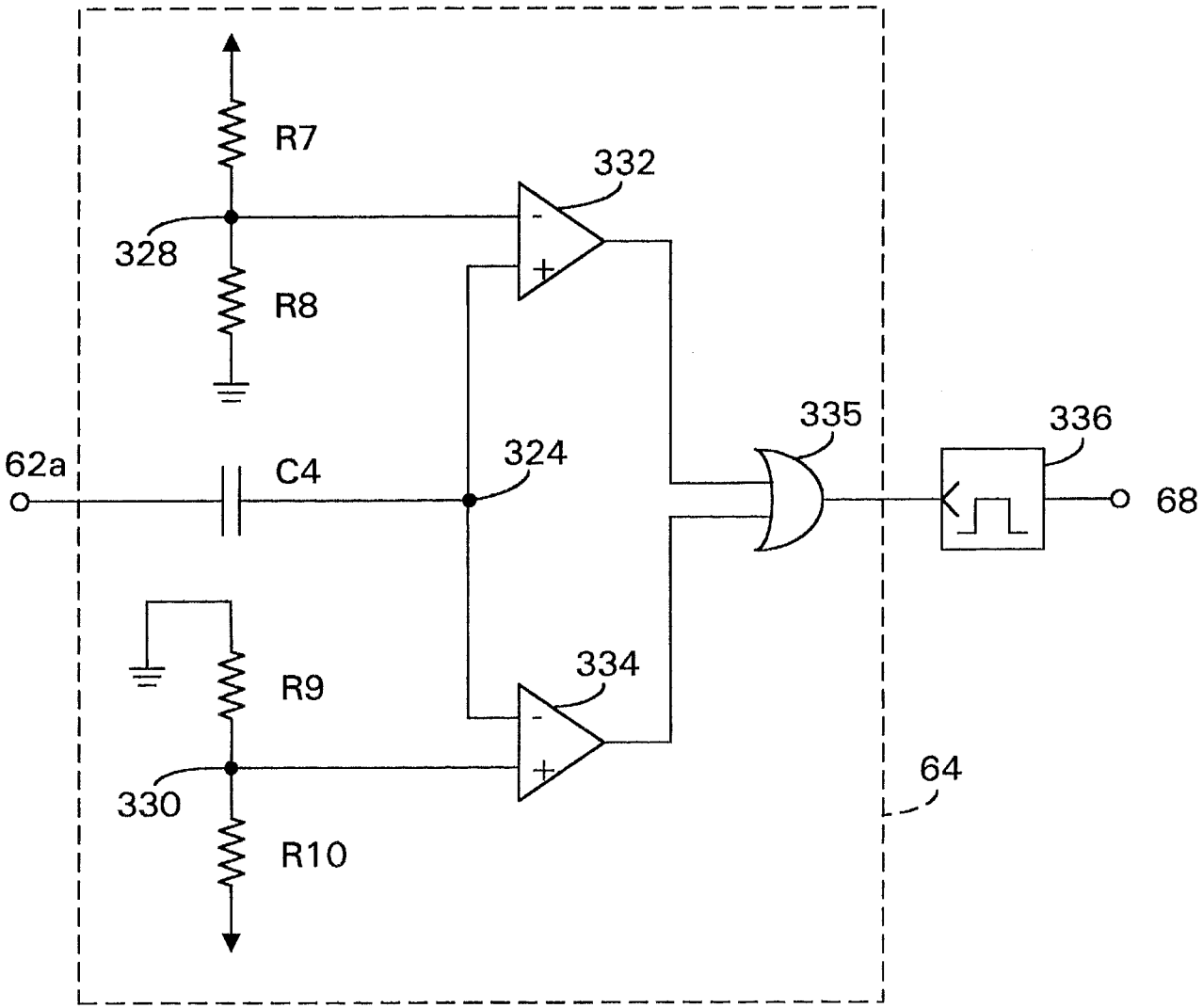
FIG. 15 is a schematic of an embodiment of an electronic circuit to perform signal processing for the preferred finger transducer of FIG. 8.

FIG. 15 is a schematic representation of an electronic circuit to perform the finger signal processing 64 just discussed. A voltage proportional to finger position 322 is differentiated by capacitor C4 and applied to two comparators 332 and 334 that tests for the presence of the differentiated signal 324 above a positive threshold 328 set by the voltage divider R7 and R8, or below a negative threshold 330, set by R9 and R10.

The finger state 68 output is a pulse generated by a monostable 336, triggered by the output of true from either comparators 332 and 334, which are logically ORed by the OR gate 335.

TACHOMETER 296 AS AN ENERGY TRANSDUCER 60

Figure 16:
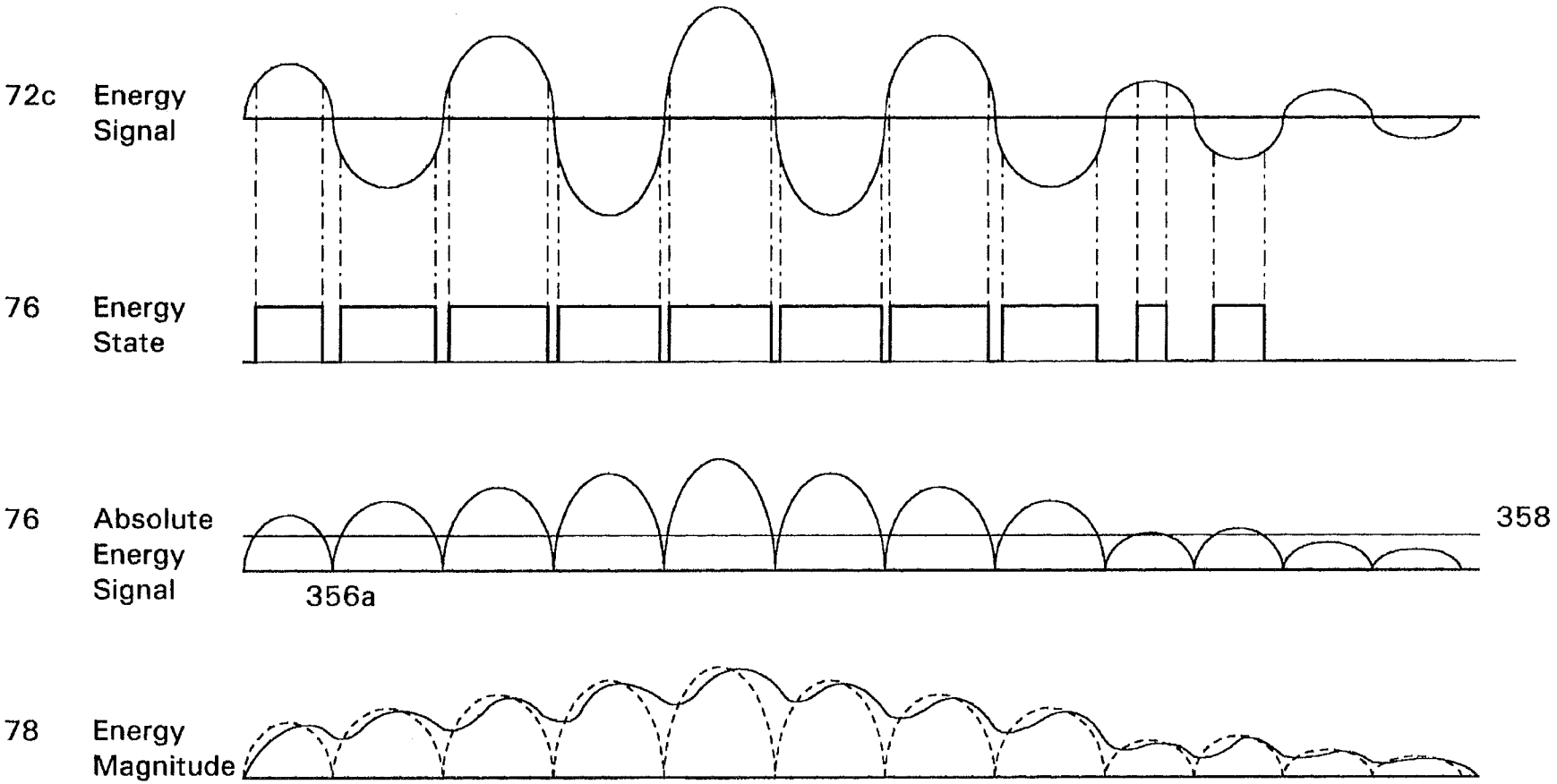
FIG. 16 illustrates by means of wave forms and timing diagrams signal processing for the tachometer to convert bow velocity to bow gestures and bow energy.

FIG. 16 shows the wave forms of energy signal processing 74 for a tachometer 296. A permanent magnetic motor, operating as a generator, is chosen as the preferred tachometer 296 due to its low cost. The motor produces an energy signal 72*c* with magnitude proportional to bow velocity, and sign determined by bow direction.

The energy signal 72*c* is displayed for several back-and-forth bowing motions. The direction of bowing determines the sign of the energy signal 72*c*. The energy state 76 is high when the absolute energy signal 356 exceeds a threshold 358, representing the smallest acceptable bow velocity. The absolute energy signal 356 can be used as the energy magnitude 78, but will usually be unacceptable as it drops to zero with every change of bow direction (e.g. at time 356*a*). A more realistic and preferred representation of energy magnitude 78 is an energy model that gives the feeling of energy attack (build-up) and decay, as happens in acoustically resonant instruments. In a preferred embodiment the energy magnitude 78 is expressed as the low-passed filtered product of the bow pressure (BP) and the absolute energy signal 356 (BV), and implemented by the following computational algorithm that is performed each time the energy magnitude 78 is updated (e.g. 60 times per second);

```
Let   Enew =    energy magnitude 78
      Eold =    Enew from last update
      BV =      absolute energy signal 356
      BP =      bow pressure
      Attack =  attack constant (0 to 1)
      Decay =   decay constant (0 to 1)
If (BV * BP > Eold)
      THEN
          Enew = Attack * ((BV * BP) − Eold) + Eold
      ELSE
          Enew = Release * ((BV * BP) − Eold) + Eold
Eold = Enew
```

For clarity, the energy magnitude 78 displayed in FIG. 16 is calculated with constant bow pressure. If bow pressure is not available, BP is set equal to 1. In a preferred embodiment, the expression processor 120 converts bow pressure and bow energy magnitude 78 into timbre brightness and volume expression commands 44, respectively. With this scheme, slow and hard bowing (small BV, large BP) produces a bright and bold timbre, and fast and light bowing (large BV, small BP) produces a light and muted timbre, yet both at the same volume since volume is the product of bow pressure and absolute energy signal 356 (BV×BP).

Figure 17:
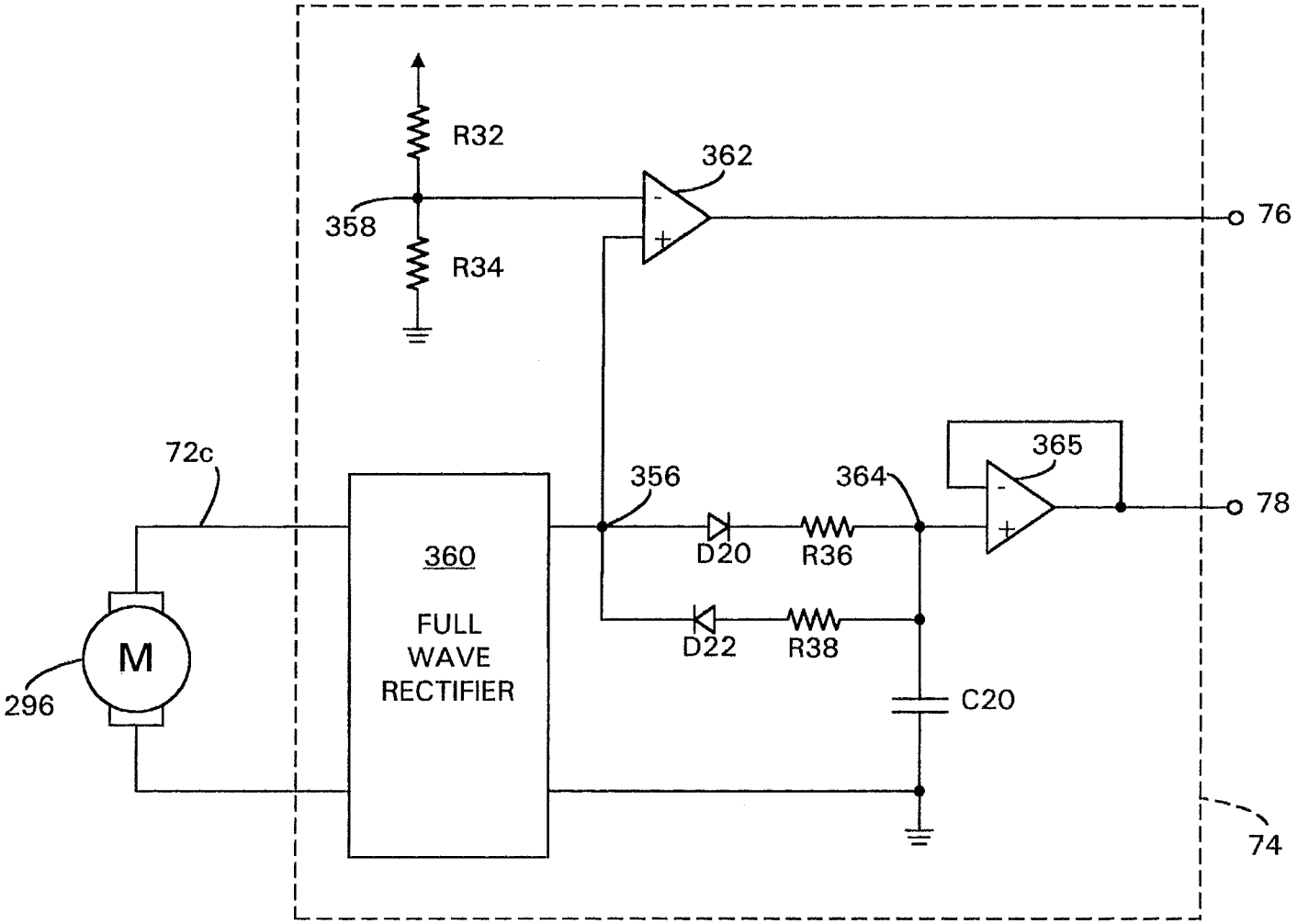
FIG. 17 is a schematic of an embodiment of an electronic circuit to perform signal processing for the tachometer to convert bow velocity to bow gestures and bow energy.

FIG. 17 shows an electronic circuit to convert the output of the tachometer 296 into a binary energy event 76 and continuous energy magnitude 78. A full wave rectifier 360 converts the tachometers output 72*c* into an absolute energy signal 356 which charges, through D20 and R36, or discharges, through D22 and R38, capacitor C20, whose voltage 364 is buffered by a voltage follower 365 and presented as the energy magnitude 78. R36 determines the attack rate, R38 the decay rate.

PIEZO-CERAMIC 284 AND OPTOINTERRUPTOR 280 AS ENERGY TRANSDUCERS 60

Figure 18:
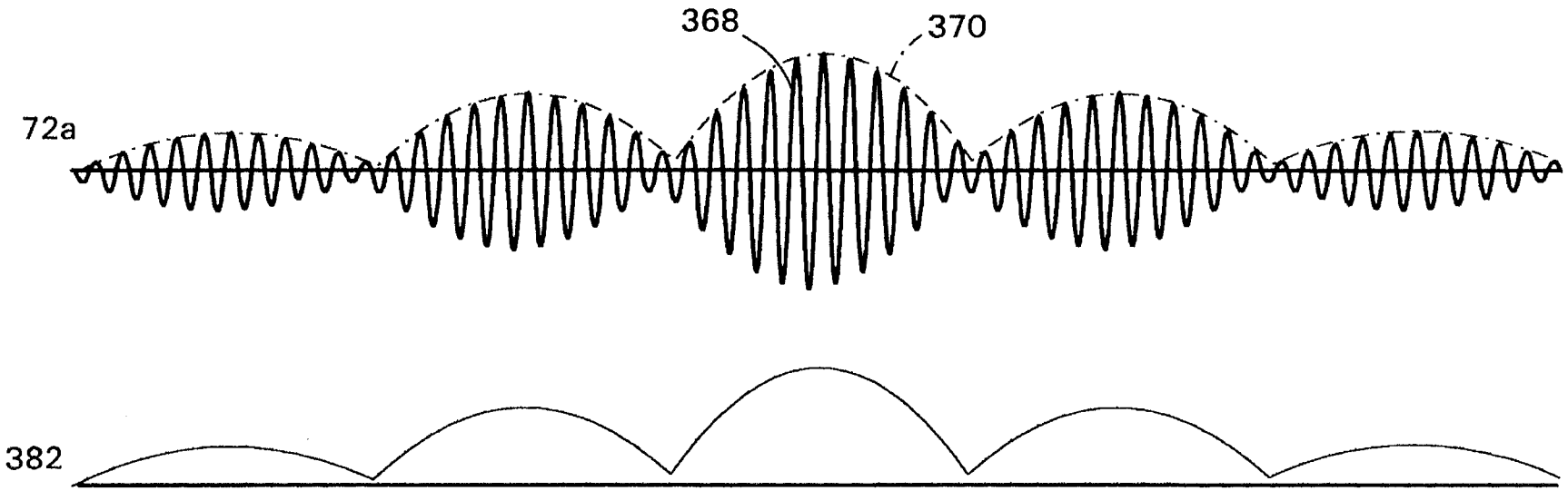
FIG. 18 illustrates by means of wave forms and timing diagrams signal processing for the optical interrupter and piezo-ceramic element, to convert string vibrations into energy magnitude and energy gestures.

FIG. 18 shows the wave forms of transducers that measure string vibration. The piezo-ceramic assembly 284 shown in FIG. 11 and optointerruptor 280 shown in FIG. 10*a* both measure string 240 vibration and so will be treated together as interchangeable energy transducers 60. The energy transducer 60 produces an energy signal 72*a* that is a composite of the string vibration frequency 368 and a slower energy envelope 370. Signal processing is used to extract the energy envelope 370 from the energy signal 72*a*, to produce an energy magnitude signal 382. The energy signal 382 is similar to the absolute energy signal 356 of the tachometer 296 and can be processed by the energy signal processor circuit 74, shown in FIG. 17, to produce desired energy state 76 events and an energy magnitude signal 78.

Figure 19:
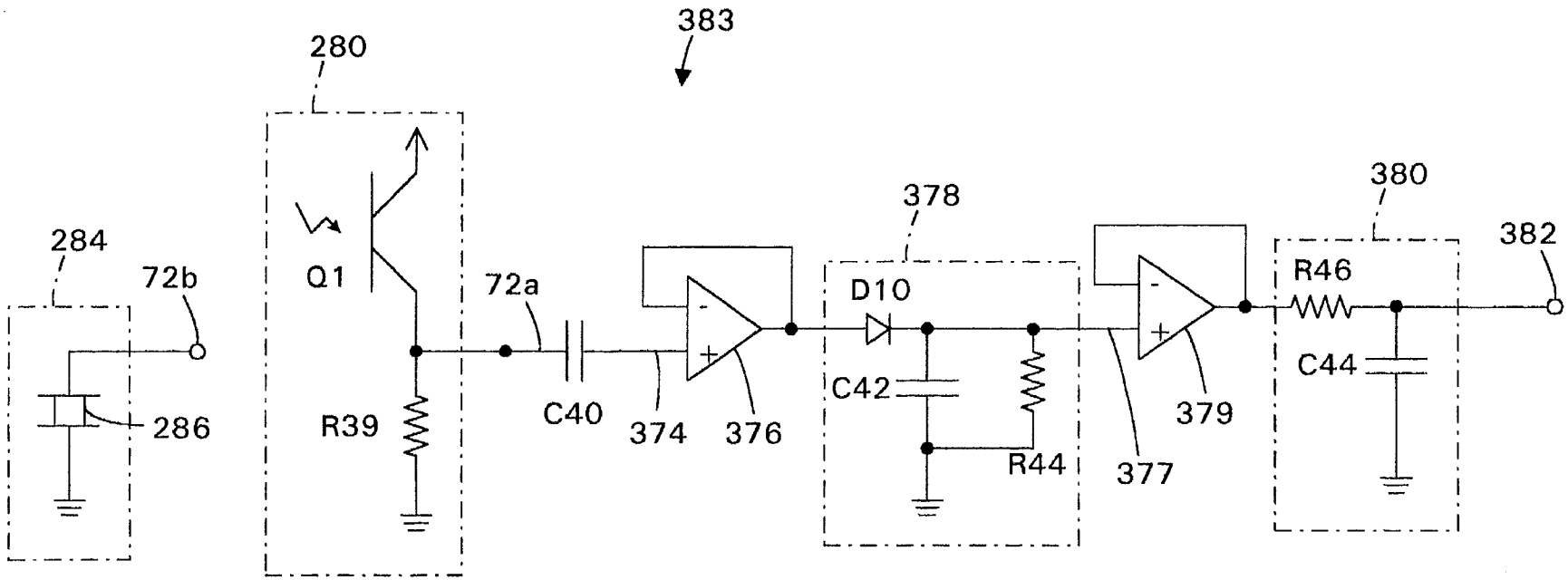
FIG. 19 is a schematic of an embodiment of an electronic circuit perform signal processing of the optical interrupter and piezo-ceramic element, to convert string vibrations into an energy envelope.

FIG. 19 shows an electronic circuit 383 to perform signal processing to convert string 240 vibrations from an energy transducer (e.g. 280 or 284) into an energy signal 382. The piezo ceramic crystal 286 generates an oscillating electrical output 72*b* in response to string 240 vibrations. The optointerrupter 280 consists of a light emitter (not shown) and a photo transistor Q1. String 240 vibrations modulate the light received by the photo transistor Q1, which passes a current through resistor R39, producing a corresponding oscillating electrical output 72*a*. The electric circuit 383 can process either oscillating electrical output 72*a* or 72*b*, so just electrical output 72*a* need be considered. The capacitor C40 removes any D.C. bias that might exist (of particular importance in the case of the optointerruptor 280) in the energy transducer signal 72*a*. The decoupled signal 374 is buffered by a voltage follower 376 and a raw energy envelope 377 is extracted by a envelope follower 378 composed of diode D10, capacitor C42, and resistor R44, and buffered by a voltage follower 379. A low-pass filter 380 made from resistor R46 and C44, smoothes the raw energy envelope 377 to produce an energy signal 382 that can be applied to the energy signal processor 74, shown in FIG. 17, to produce an energy state 76 and energy magnitude 78 signal. R44 and C42 can be adjusted to change the decay time of the energy signal 382. This is particularly useful on instrument controllers such as guitar and bass where the strings are picked and some sustain is desired. As the value of R44 and C42 increase, so does the decay time.

PLATFORMS

Many entertainment, multimedia computers, and audio-visual systems can be used as a hardware platform for the invention. The function of many of the system components of the invention can be implemented using the resources of the target machine. Entertainment systems include the NES by Nintendo, the Genesis machine by Sega, the CDI machine by Panasonic, and the 3D0 machine by 3D0. Some of these units have their own sound synthesizers which can be used in place of the music synthesizer 18. Signal processing circuits have been shown that can be used and adapted, by one skilled in the art of electronics and computer programming, to many of the multimedia computers, video games, and entertainment systems commercially available, some of which have been listed here.

SUMMARY

The controller model 6 has been designed to accommodate a wide variety of musical instruments using low-cost transducers and simple signal processing, while maintaining a high degree of expression and control. The scheduler 28 is flexible enough to cover mistakes of beginners and allow great tempo and rubato control for proficient players. The simultaneous margin processor 122 can process conventional MIDI song files automatically, without player intervention, providing the player access to a large library of commercially available song files. The ability to selectively edit note timing and expression commands by re-performance and score 4 recycling allows a person to add life to song files.

The ability of the simultaneous margins 150 to adjust themselves to compensate for repeated mistakes by the player over several rehearsals, allows the music re-performance system 2 to learn, producing a better performance each time through.

The ability of the scheduler 23 to reattack notes allows the player room to improvise. Musicians often reattack notes for ornamentations. The polygestural scheduler 34 provides a guitarist with the ability to strum any sequence of stings with any rhythm, and the scheduler allocator 54 provides a smooth intuitive method to switch between rhythm and lead lines. The polygestural scheduler 34 also allows a player to select alternate musical lines from the score. A violinist could play one string for melody, another for harmony, and both for a duet. A bass player could use one string for the root of the chord, another for the fifth interval, a third for a sequence of notes comprising a walking bass line, and a forth string for the melody line, and effortlessly switch among them by plucking the appropriate string.

The modularity of the schedulers 28 permits each to have their own simultaneous margin 150 and rubato window 170, allowing several people of different skill levels to play together, for example as a string quartet, rock or jazz band. The integration of the controllers 6, schedulers 28, score 4, display 24, and accompaniment sequencer 42, provides a robust music education system that can grow with the developing skills of the player.

Although the present invention has been shown and described with respect to preferred embodiments, various changes and modifications which are obvious to a person skilled in the art to which the invention pertains are deemed to lie within the spirit and scope of the invention.

What we claim as our invention is:

1. A music re-performance system to generate music in response to musical gestures of a player comprising;

(a) storage means for storing information defining at least note pitch and note timing in at least one preprogrammed musical channel;

(b) finger transducer means for receiving finger manipulations from a player and for generating and for outputting a finger signal in response to said finger manipulations;

(c) energy transducer means for receiving energy applied by a player and for generating and outputting an energy signal in response to said energy applied to said energy transducer means by the player;

(d) signal processing means connected to said finger transducer means and to said energy transducer means for receiving said finger signal and said energy signal and for generating at least one gesture signal in response to said finger signal and to said energy signal;

(e) scheduling means connected to said storage means and to said signal processing means, for sequentially selecting at least one note from said storage means and for transmitting the selected note in response to said gesture signal; and (f) sound generator means connected to said scheduling means for receiving the transmitted selected note and for producing sound in response to said selected notes.

2. A music re-performance system as set forth in claim 1, further comprising at least one additional preprogrammed musical channel storing at least note and note timing information thus defining a musical accompaniment, and an accompaniment sequence means for reproducing said additional preprogrammed musical channel.

3. A music re-performance system as set forth in claim 2, further comprising accompaniment tempo regulation means to regulate the tempo of the reproduction of said additional preprogrammed musical channel by the temporal relationship between said gesture signal and said note timing information.

4. A music re-performance system as set forth in claim 3, wherein the tempo of reproduction increases when said gesture signal temporally leads said note timing information, and said tempo decreases when said gesture signal temporally lags said note timing information, resulting in the tempo of reproduction following the tempo of the player.

5. A music re-performance system as set forth in claim 1, wherein said signal processing means further includes temporal masking means for generating a single gesture signal in response to a combination of finger and energy signals occurring within a temporal masking margin, thereby allowing finger and energy signals intended by the player to be simultaneous to generate a single gesture signal.

6. A music re-performance system as set forth in claim 5, wherein said temporal masking margin lasts for a fraction of the duration of the note selected by said scheduling means.

7. A music re-performance system as set forth in claim 1, further comprising expressive processing means for receiving said energy signal and for converting said energy signal into at least one control signal and for affecting change in at least one expressive parameter selected from the group consisting of volume, timbre, vibrato, and tremolo, whereby a player can control said expressive parameter through the energy applied to said energy transducer means.

8. A music re-performance system as set forth in claim 7, wherein the said finger transducer means comprises a conductive wire suspended over a fingerboard whose surface is at least partially covered by a semi-conductive material, across the length of which a voltage potential is applied, whereby an electric signal proportional to the contact position along said fingerboard is produced in the wire when said wire is depressed thus contacting said semi-conductive material.

9. A music re-performance system as set forth in claim 1, wherein said energy transducer means comprises at least one elongated member set into motion by a player energy gesture, whereby said energy transducer means produces an electric signal in response to the energy applied to said energy transducer means by said player energy gesture.

10. A music re-performance system as set forth in claim 9, further comprising;

(a) a structure resembling a guitar wherein said finger transducer means is disposed along the neck of said structure and said energy transducer is disposed on the body of said structure;

(b) two preprogrammed musical channels, one defining a lead melody and the other defining chords;

(c) a scheduler allocator means connected to the two preprogrammed musical channels and to said scheduling means, said scheduler allocator means selecting said lead melody if said finger manipulations are applied to said finger transducer at a location substantially near the body of said structure, and otherwise said scheduler allocator means selecting said preprogrammed musical channel defining chords if said finger manipulations are applied to said finger transducer means at a location substantially far from the body of said structure, whereby said finger manipulations and said player energy gestures resemble the gestures of playing a guitar 11. A music re-performance system as set forth in claim 9, wherein said energy transducer means further includes an optical interrupter means allowing at least some motion of said elongated member eclipsing at least some of the optical path of said optical interrupter means, said optical interrupter means producing an electric signal in response to the motion of said elongated member.

12. A music re-performance system as set forth in claim 9, wherein said energy transducer means further includes a piezoelectric device in intimate contact with said elongated member, said piezoelectric device converting said motion into an electric signal in response to the motion of said elongated member.

13. A music re-performance system as set forth in claim 1, wherein said energy transducer means comprises a rotating cylinder means allowing rotation by bowing actions of the player, further including rotational measurement means for producing an electric signal indicating rotation speed and direction, thus producing an electric signal indicating bow speed and direction.

14. A music re-performance system as set forth in claim 2, further comprising a structure resembling a violin wherein said energy transducer means is disposed on the body of the structure and said finger transducer means is disposed along the neck of said structure, whereby said finger manipulations and said energy applied resembles the gestures of playing a violin.

15. A music re-performance system as set forth in claim 1, wherein said energy transducer means further includes;

(a) an articulated member allowing a change in physical state, selected from the group consisting of position, compression, and tension, by the actions of the player;

(b) sensing means to convert said change in physical state into electric signals; and (c) signal processing means to convert said electric signals into processed signals in response to the magnitude of said actions.

16. A music re-performance system as set forth in claim 1, wherein said scheduling means further comprises means for selecting a plurality of notes from said storage means in response to a single gesture signal.

17. A music re-performance system as set forth in claim 16, wherein the selection of said plurality of notes is determined by a temporal simultaneous margin, said temporal simultaneous margin chosen from among the following; a constant value, a percentage of the duration of a selected note, a value set by the player, a value stored in said storage means, or a sequence of values stored in said storage means.

18. A music re-performance system as set forth in claim 1, wherein said scheduling means further comprises, a rubato tolerance means for limiting the magnitude of the temporal difference between said note timing as specified in said storage means and the transmission of said selected note.

19. A music re-performance system as set forth in claim 1, further comprising;

(a) a plurality of said finger transducers, outputting at least one finger signal in response to said finger manipulations of said finger transducer means;

(b) a plurality of said energy transducer means, for outputting at least one energy signal in response to energy applied to said energy transducer means;

(c) a plurality of said preprogrammed musical channels;

(d) signal processing means for receiving said finger signal and said energy signal and for generating at least one gesture signal in response to said finger signal and to said energy signal;

(e) polygestural scheduling means, connected to said storage means and said signal processing means, for selecting a plurality of notes from a plurality of said preprogrammed musical channels, whereby a temporal sequence of polyphonic music can be regulated by a combination of finger manipulations applied to said finger transducer means and energy applied to said energy transducer means.

20. A music re-performance system as set forth in claim 1, further comprising computing means connected to said storage means for generating a visual representation of information contained in said preprogrammed musical channel.

21. A music editing system to edit selected note parameters of a musical score by dynamically changing the note parameters comprising;

(a) an information storage means for storing at least one preprogrammed musical channel defining at least one note parameter selected from the group consisting of pitch, start time, stop time, duration, volume, timbre, vibrato, and tremolo, where said musical channel represents the musical score to be edited;

(b) energy transducer means for receiving energy applied by a player and for generating and for outputting an energy signal in response to said energy applied to said energy transducer means;

(c) signal processing means connected to said energy transducer means for receiving said energy signal and for generating at least one energy control signal in response to said energy signal;

(d) scheduling means connected to said storage means and to said signal processing means for sequentially selecting at least one note parameter and for altering said note parameter in response to said energy control signal, whereby said altering represents an edited version of said note parameter; and (e) sound generator means connected to said scheduling means for receiving said altered note parameter and producing sound in response to said altered note parameter.

22. A music editing system as set forth in claim 21, further comprising at least one additional preprogrammed musical channel for storing at least note pitch and note timing information thus defining a musical accompaniment, and an accompaniment sequence means for reproducing said additional preprogrammed musical channel.

23. A music editing system as set forth in claim 22, further comprising accompaniment tempo regulation means to regulate the tempo of the reproduction of said additional preprogrammed musical channel by the temporal relationship between said energy control signal and note timing information stored in said preprogrammed musical channel, whereby the tempo of said accompaniment responds to the timing of said energy signal.

24. A music editing system as set forth in claim 21, further comprising finger transducer means connected to said signal processing means to receive finger manipulations from a player and for generating and for outputting a finger signal in response to said finger manipulations, said signal processing means receiving said finger signal and generating at least one finger control signal in response to said finger signal and said scheduling means altering said note parameter in response to said finger control signal.

25. A music editing system as set forth in claim 24, wherein said signal processing means further includes temporal masking means for generating a single gesture signal in response to a combination of said finger signal and said energy signal received within a temporal masking margin, thereby using said gesture signal for altering the timing of notes in said preprogrammed musical channel.

26. A music editing system as set forth in claim 25, wherein said temporal masking margin lasts for a fraction of the duration of the note selected by said scheduling means.

27. A music editing system as set forth in claim 21, wherein said scheduling means further comprises a rubato tolerance means for limiting the magnitude of temporal alterations of note parameters.

28. A music editing system as set forth in claim 21, further comprising computing means connected to said storage means for generating a visual representation of information contained in said preprogrammed musical channel.

29. A music re-performance system to generate music in response to musical gestures of a player comprising;

(a) storage means for storing information defining at least note and note timing in at least one preprogrammed musical channel;

(b) an energy transducer means for receiving player gestures and generating at least one energy signal in response to at least one said player gesture performed on said energy transducer means;

(c) signal processing means connected to said energy transducer means for receiving said energy signal and for generating a gesture signal in response to said energy applied to said energy transducer means;

(d) scheduler means connected to said storage means and to said energy transducer means, for sequentially selecting notes from said storage means that occur within a temporal simultaneous margin, and for transmitting the selected notes in response to said gesture signal, whereby a single player gesture may result in a plurality of transmitted notes; and (e) sound generator means connected to said scheduler means, for receiving the transmitted selected notes and for producing sound in response to said selected notes.

30. A music re-performance system as set forth in claim 29, wherein said temporal simultaneous margin is chosen from among the following; a constant value, a percentage of the duration of a selected notes, a value set by the player, a value stored in said storage means, or a sequence of values stored in said storage means.

31. A music re-performance system as set forth in claim 30 wherein said scheduling means further comprises rubato tolerance processing means for limiting the magnitude of the temporal difference between said note timing as specified in said storage means and the transmission of said selected note.

32. A music re-performance system as set forth in claim 29, further comprising at least one additional preprogrammed musical channel for storing at least note and note timing information thus defining a musical accompaniment, and an accompaniment sequence means for reproducing said additional preprogrammed musical channel.

33. A music re-performance system as set forth in claim 32, further comprising accompaniment tempo regulation means to regulate the tempo of the reproduction of said additional preprogrammed musical channel by the temporal relationship between said gesture signal and said note timing information, resulting in the tempo of said accompaniment responding to the timing of musical gestures of the player.

34. A music re-performance system as set forth in claim 29, further comprising expressive processing means to receive said energy signal and for converting said energy signal into at least one control signal for effecting change in at least one expressive parameter selected from the group consisting of volume, timbre, vibrato, and tremolo, for controlling said expressive parameter through the energy applied to said energy transducer.

* * * * *